US011524220B2

(12) United States Patent
Priest

(10) Patent No.: US 11,524,220 B2
(45) Date of Patent: Dec. 13, 2022

(54) SKI BINDING

(71) Applicant: Ryan Priest, Geneva (CH)

(72) Inventor: Ryan Priest, Geneva (CH)

( * ) Notice: Subject to any disclaimer, the term of this patent is extended or adjusted under 35 U.S.C. 154(b) by 0 days.

(21) Appl. No.: 17/258,562

(22) PCT Filed: Jul. 8, 2019

(86) PCT No.: PCT/CH2019/050013
§ 371 (c)(1),
(2) Date: Jan. 7, 2021

(87) PCT Pub. No.: WO2020/010477
PCT Pub. Date: Jan. 16, 2020

(65) Prior Publication Data

US 2021/0268364 A1 Sep. 2, 2021

(30) Foreign Application Priority Data

Jul. 9, 2018 (CH) ..... 851/18
Sep. 4, 2018 (CH) ..... 1054/18
Feb. 17, 2019 (CH) ..... 196/19

(51) Int. Cl.
*A63C 9/085* (2012.01)
*A63C 9/08* (2012.01)

(52) U.S. Cl.
CPC ..... *A63C 9/08521* (2013.01); *A63C 9/0807* (2013.01); *A63C 9/08585* (2013.01)

(58) Field of Classification Search
CPC ..... A63C 9/0807; A63C 9/08528; A63C 9/08557; A63C 9/08571; A63C 9/086;
(Continued)

(56) References Cited

U.S. PATENT DOCUMENTS 3,873,113 A * 3/1975 Suhner ..... A63C 9/0805 280/625
3,893,685 A * 7/1975 Svoboda ..... A63C 9/001 280/634
(Continued)

FOREIGN PATENT DOCUMENTS

CN 2495086 Y * 6/2022
EP 0 199 098 A2 10/1986
(Continued)

OTHER PUBLICATIONS

International Search Report from Corresponding International Application No. PCT/CH2019/050013 dated Oct. 10, 2019.
(Continued)

*Primary Examiner* — James A Shriver, II
*Assistant Examiner* — Michael T. Walsh
(74) *Attorney, Agent, or Firm* — Pearne & Gordon LLP

(57) ABSTRACT

A front ski binding assembly for a ski board, including a front boot-retaining mechanism retaining a boot in a slope ascending or descending utilisation, two first articulated arms pivotably mounted on a platform, a lateral security release device arranged in cooperation with first ends of first articulated arms to apply thereon a biasing force urging second ends of first articulated arms towards the longitudinal axis of the platform and allow each first articulated arms to rotate away from the longitudinal axis upon application by a boot of force higher than the biasing force on an interior surface of a first articulated arm, and two second articulated arms pivotably mounted about a second arbor and bearing at an end touring pins to engage corresponding mating members on front end sides of a boot in slope ascending utilisation, the second articulated arms being movable between an active and inactive position.

20 Claims, 19 Drawing Sheets

(58) Field of Classification Search
CPC .... A63C 9/22; A63C 9/08521; A63C 9/08585
See application file for complete search history.

(56) References Cited

U.S. PATENT DOCUMENTS

| | | | | | |
|---|---|---|---|---|---|
| 4,029,336 | A * | 6/1977 | Haimerl | A63C 9/0807 | 280/619 |
| 4,348,036 | A * | 9/1982 | Settembre | A63C 9/0807 | 280/615 |
| 4,429,896 | A * | 2/1984 | Spademan | A63C 9/08535 | 280/624 |
| 5,527,057 | A * | 6/1996 | Stritzl | A63C 9/08564 | 280/634 |
| 8,894,087 | B2 * | 11/2014 | Barthel | A63C 9/08521 | 280/614 |
| 9,120,002 | B2 * | 9/2015 | Barthel | A63C 9/085 | |
| 9,220,969 | B2 | 12/2015 | Soldan et al. | | |
| 9,526,972 | B2 | 12/2016 | Steinke et al. | | |
| 9,795,862 | B2 | 10/2017 | Soldan et al. | | |
| 2010/0253021 | A1 * | 10/2010 | Kostantin | A63C 9/20 | 280/11.33 |
| 2013/0207356 | A1 * | 8/2013 | Barthel | A63C 9/0807 | 280/11.33 |
| 2013/0214513 | A1 * | 8/2013 | Barthel | A63C 9/0807 | 280/614 |
| 2013/0334795 | A1 * | 12/2013 | Alzner | A63C 9/08571 | 280/611 |
| 2018/0185737 | A1 * | 7/2018 | Zoor | A63C 9/085 | |

FOREIGN PATENT DOCUMENTS

| | | | | |
|---|---|---|---|---|
| EP | 1174165 | A2 * | 1/2002 | A63C 9/0841 |
| EP | 1378275 | A1 * | 1/2004 | A63C 9/003 |
| EP | 2609972 | A1 * | 7/2013 | A63C 7/1026 |
| EP | 2 626 116 | A1 | 8/2013 | |
| EP | 2 662 121 | A2 | 11/2013 | |
| EP | 2687275 | A1 * | 1/2014 | A63C 9/003 |
| EP | 2 774 661 | A2 | 9/2014 | |
| EP | 2774661 | A2 * | 9/2014 | A63C 7/12 |
| EP | 2923742 | A1 * | 9/2015 | A63C 9/08521 |
| EP | 2 929 918 | A1 | 10/2015 | |
| EP | 2 944 361 | A1 | 11/2015 | |
| EP | 2 987 538 | A1 | 2/2016 | |
| FR | 2 567 409 | A1 | 1/1986 | |
| FR | 2986975 | A1 * | 8/2013 | A63C 9/003 |
| WO | WO-8300633 | A * | 3/1983 | |
| WO | WO-8300633 | A1 * | 3/1983 | |
| WO | WO-2017095232 | A1 * | 6/2017 | A63C 9/0802 |

OTHER PUBLICATIONS

Written Opinion from Corresponding International Application No. PCT/CH2019/050013 dated Oct. 10, 2019.

* cited by examiner

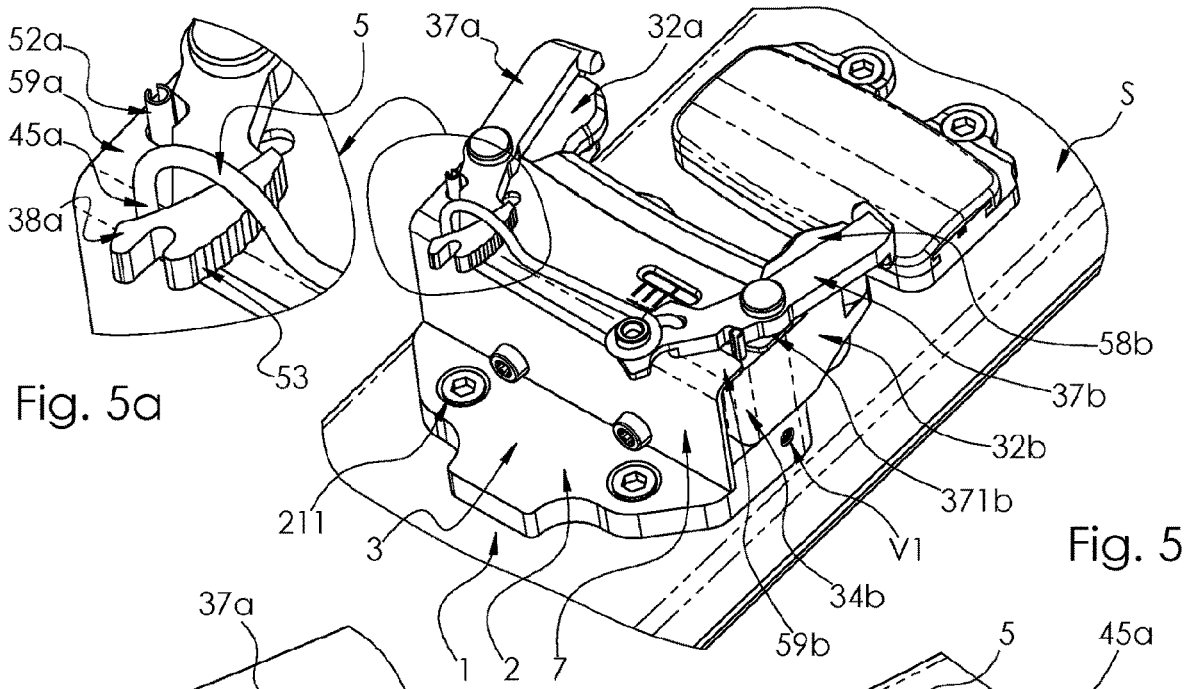
Fig. 5a
Fig. 5
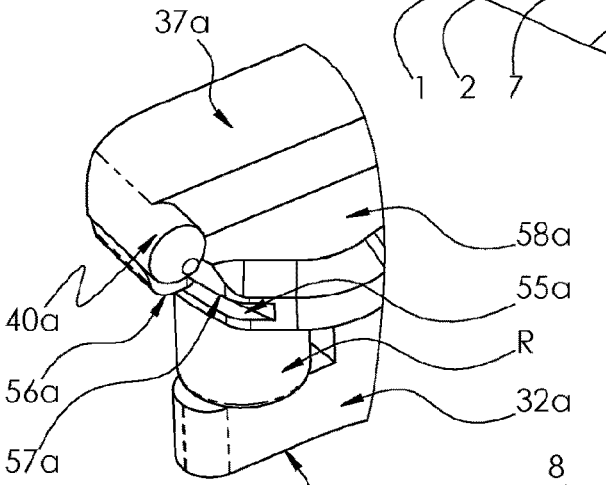
Fig. 6a
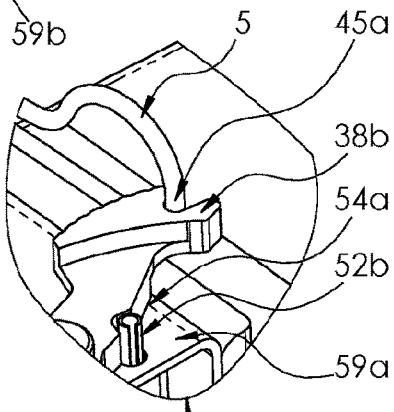
Fig. 6b
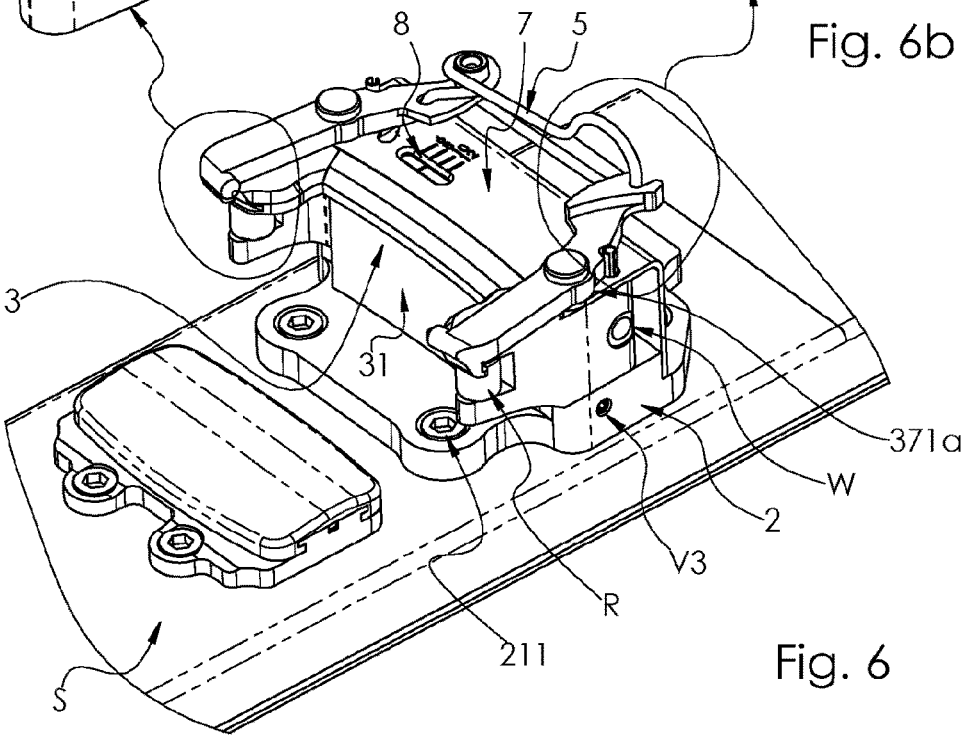
Fig. 6

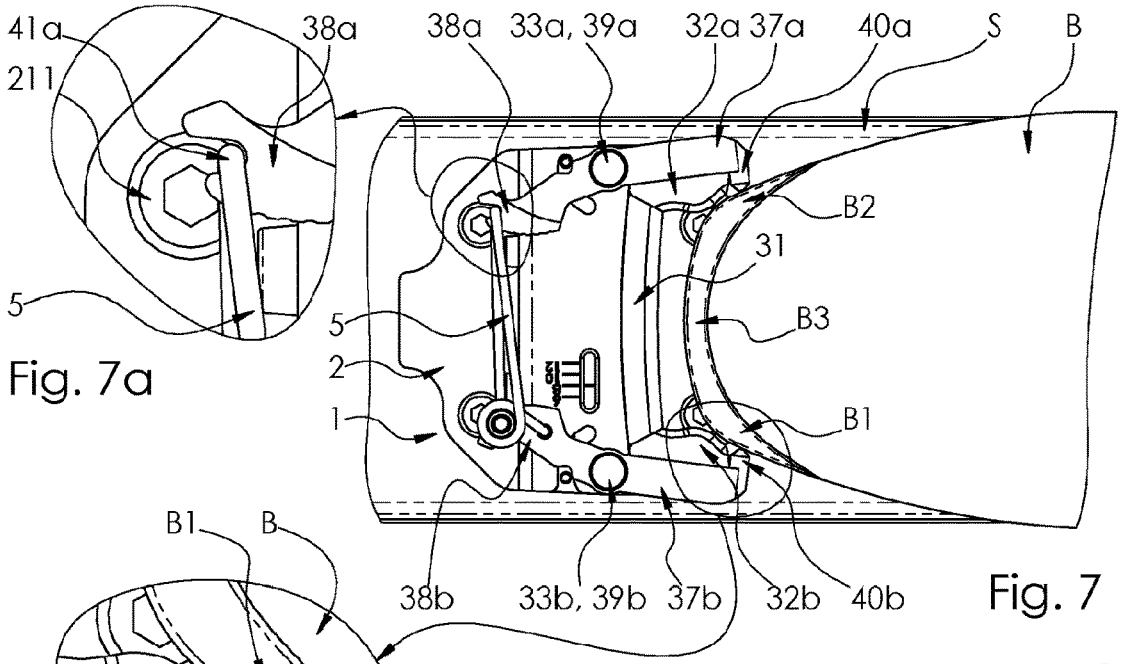
Fig. 7a
Fig. 7
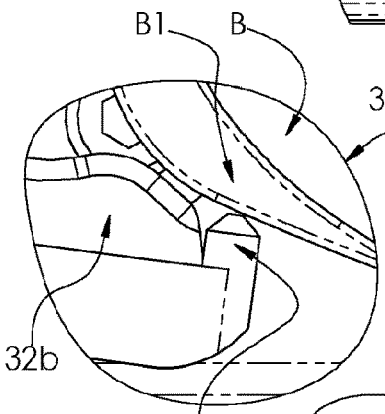
Fig. 7b
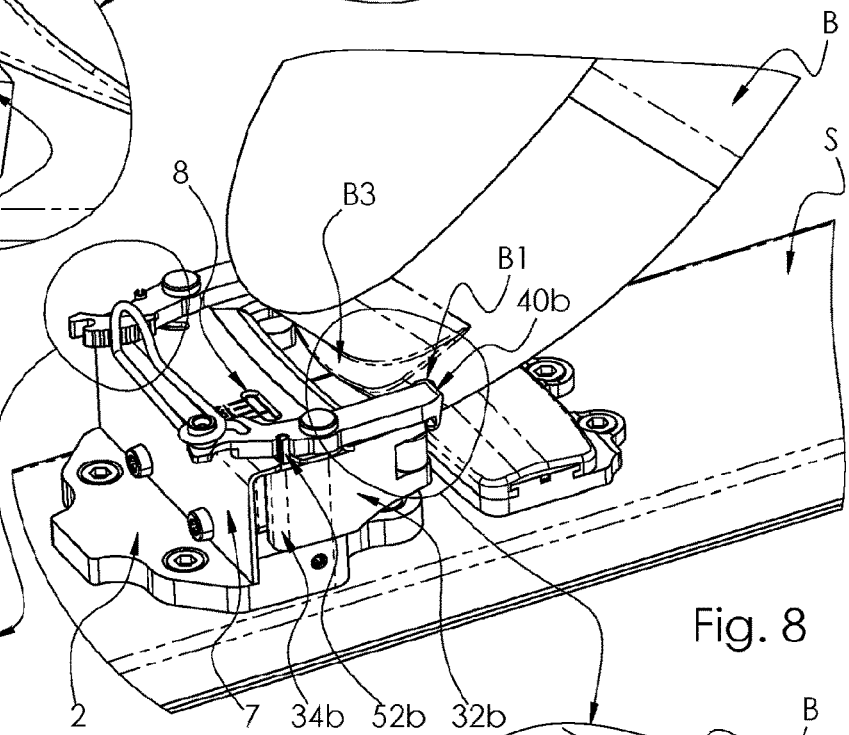
Fig. 8
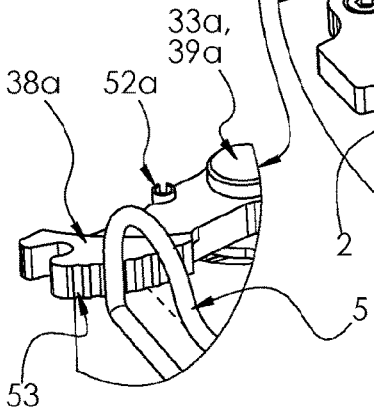
Fig. 8a
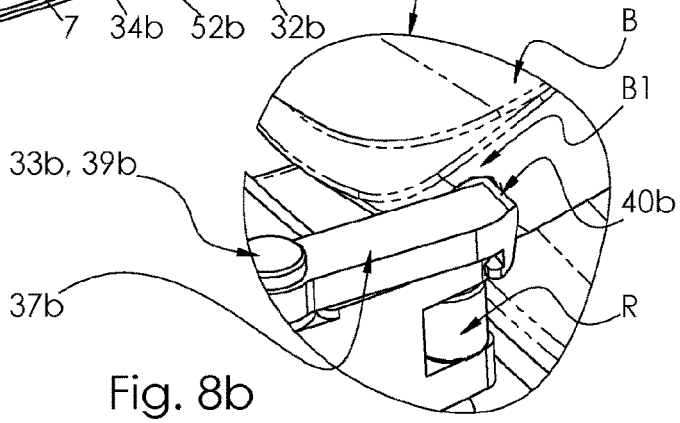
Fig. 8b

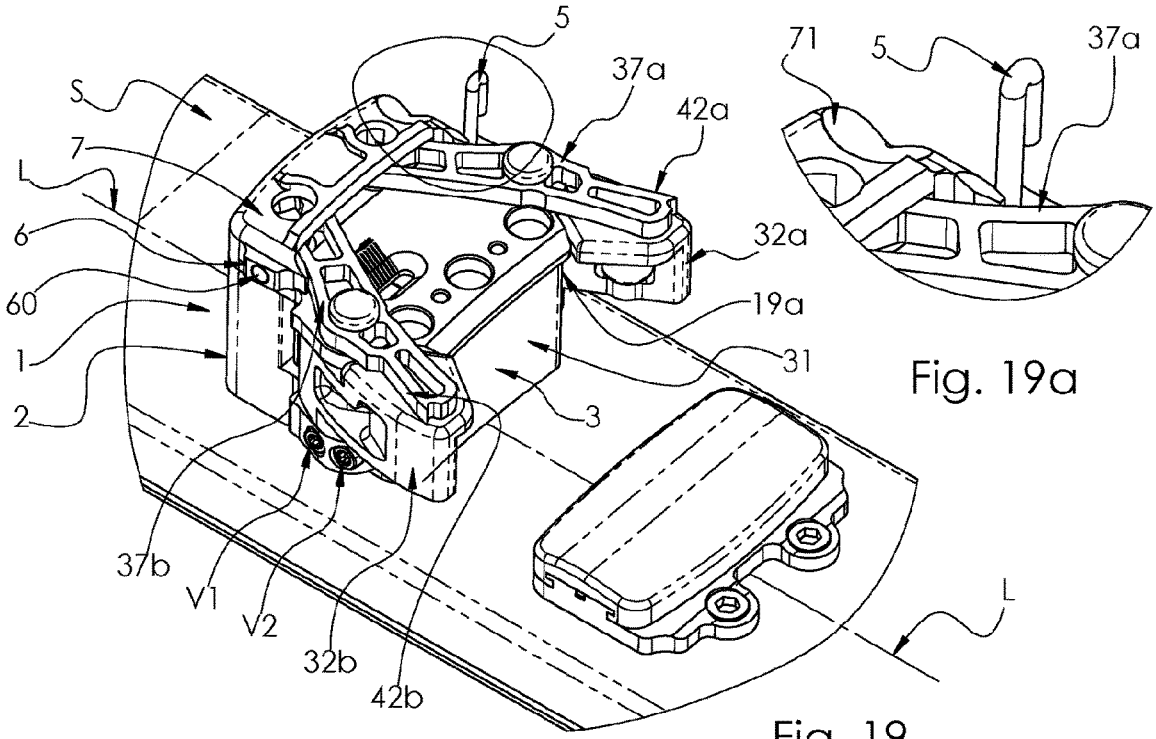
Fig. 19a
Fig. 19
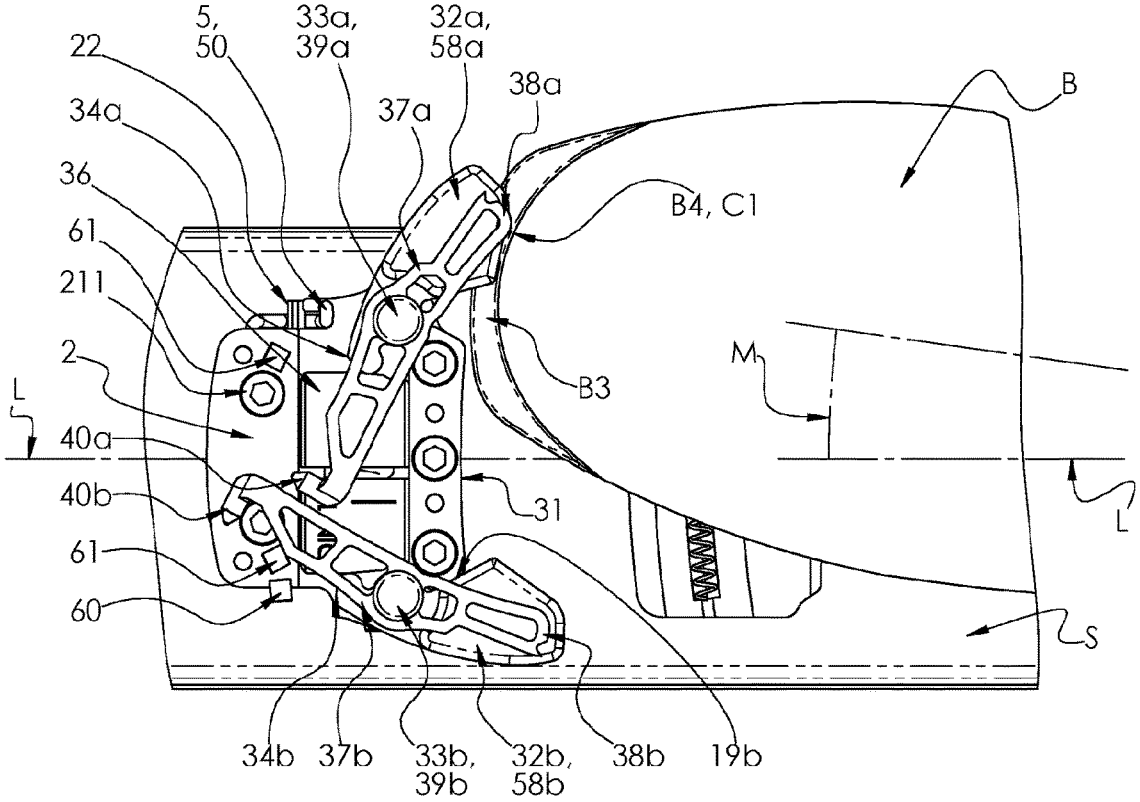
Fig. 20

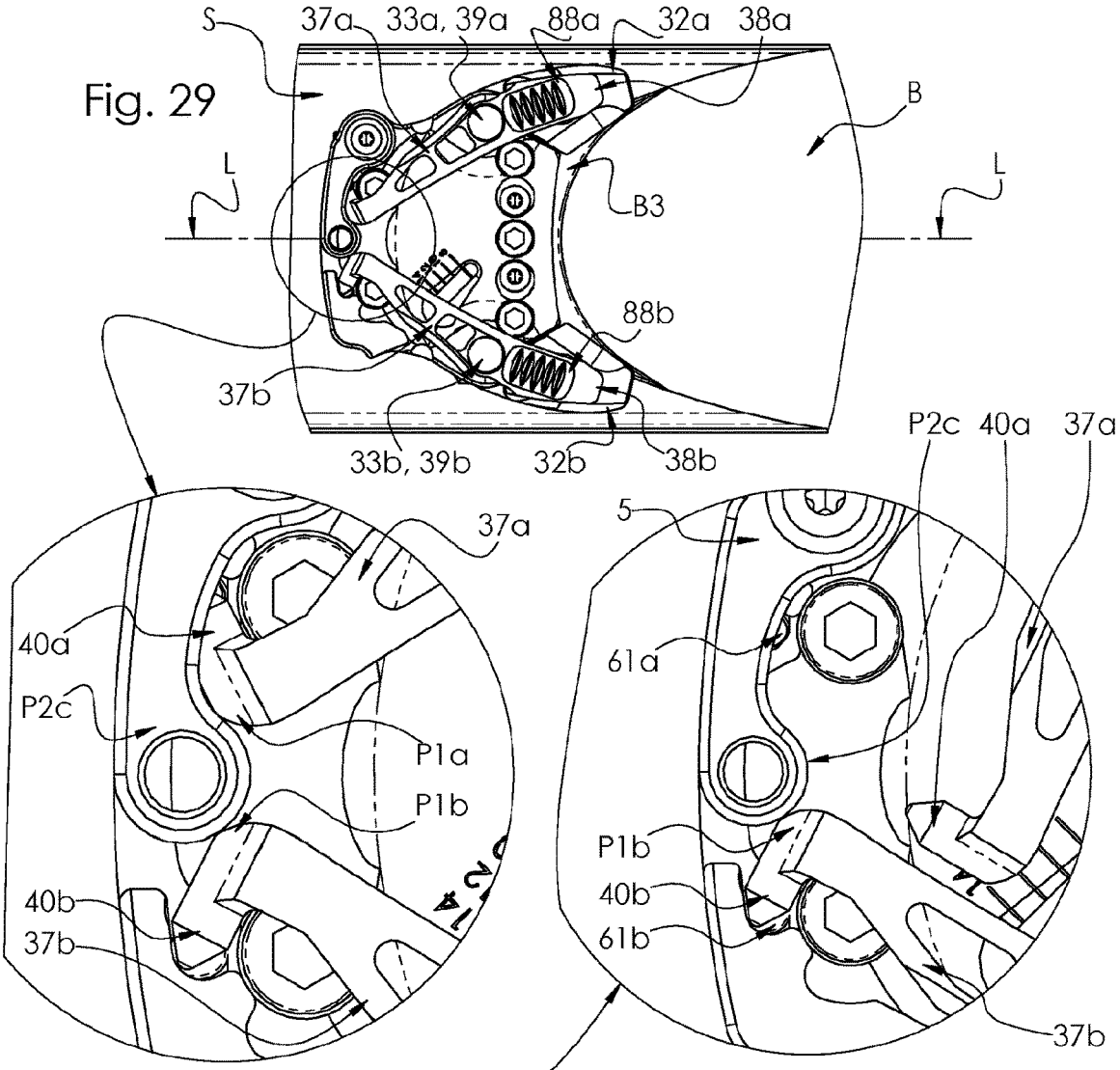
Fig. 29
Fig. 29a
Fig. 30b
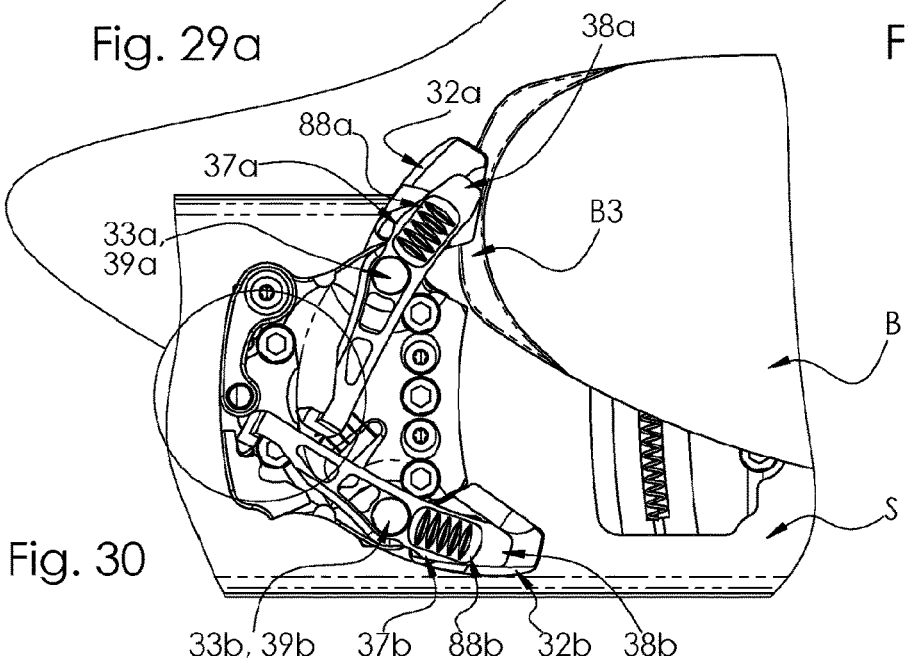
Fig. 30

Fig. 32
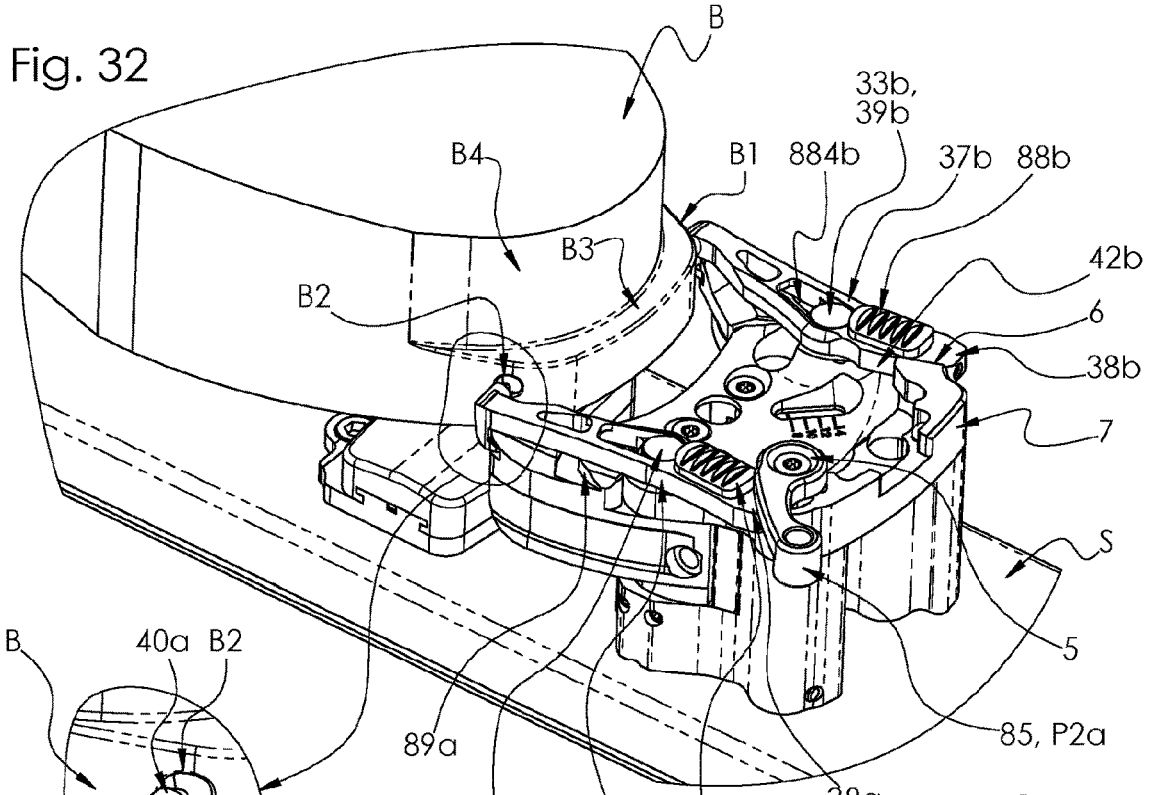
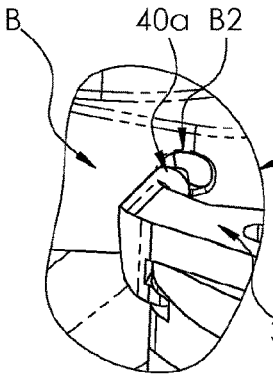
Fig. 32a
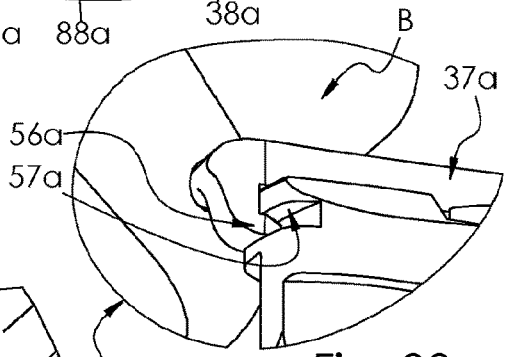
Fig. 33a
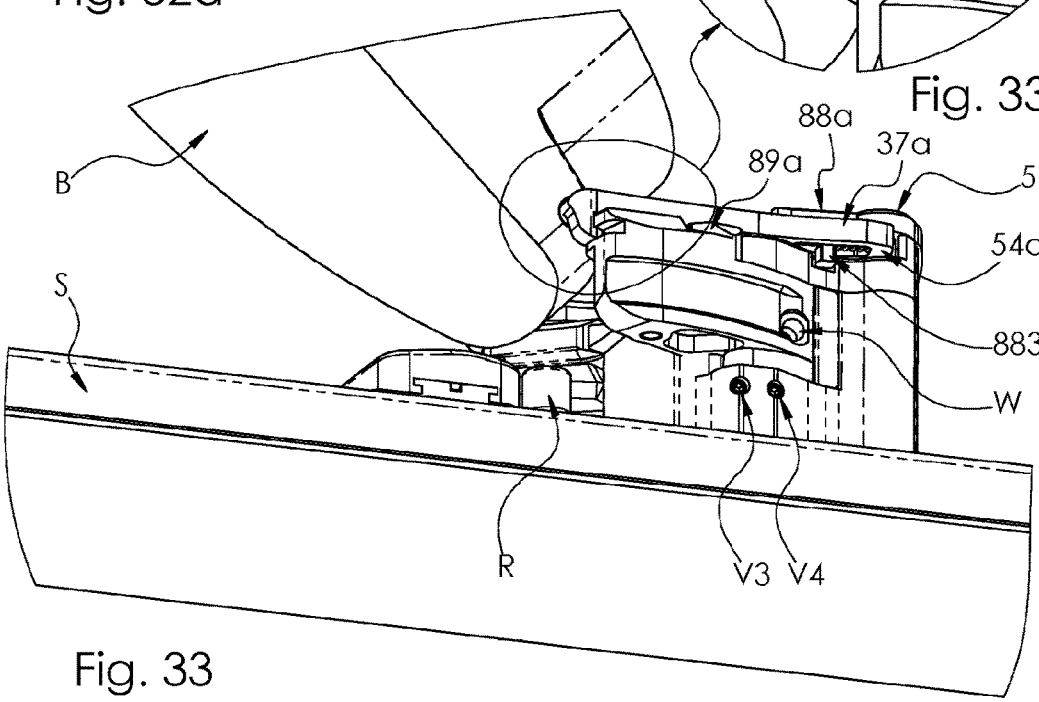
Fig. 33

Fig. 34
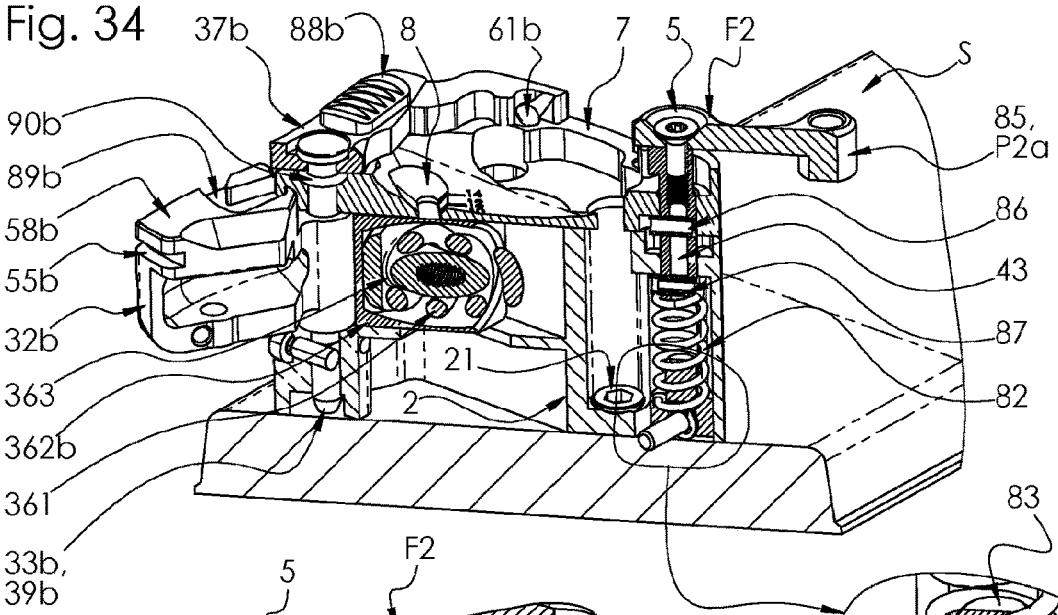
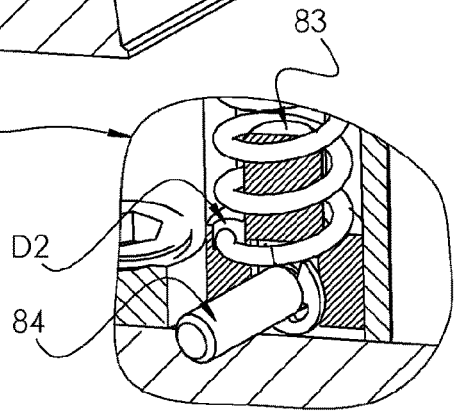
Fig. 34a
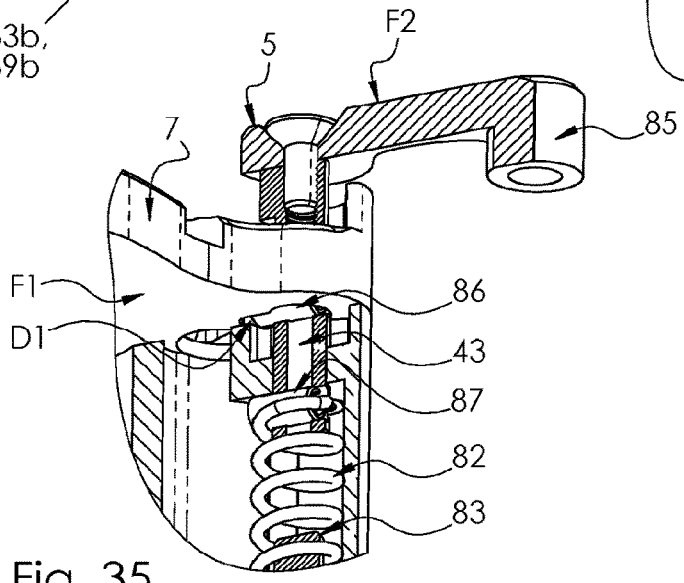
Fig. 35
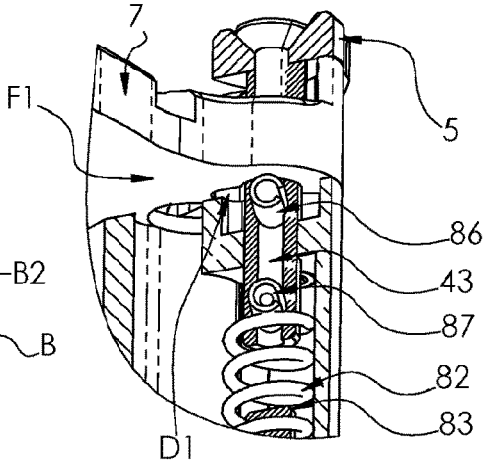
Fig. 36
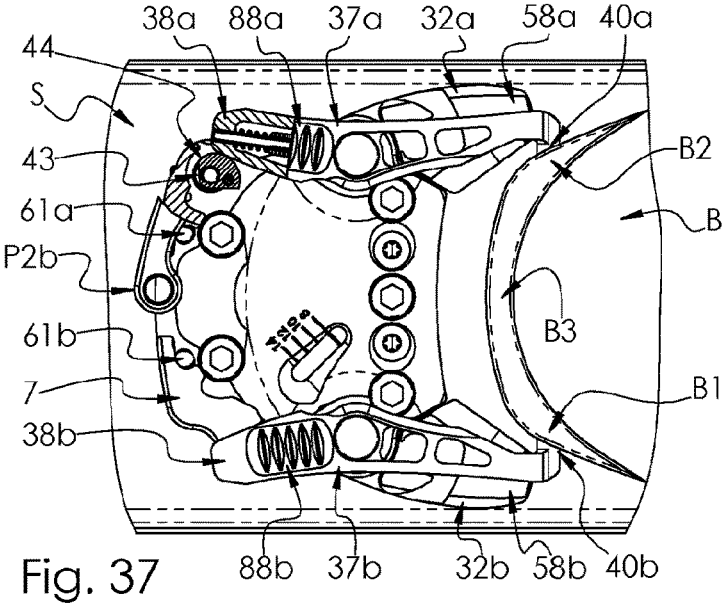
Fig. 37

Fig. 38
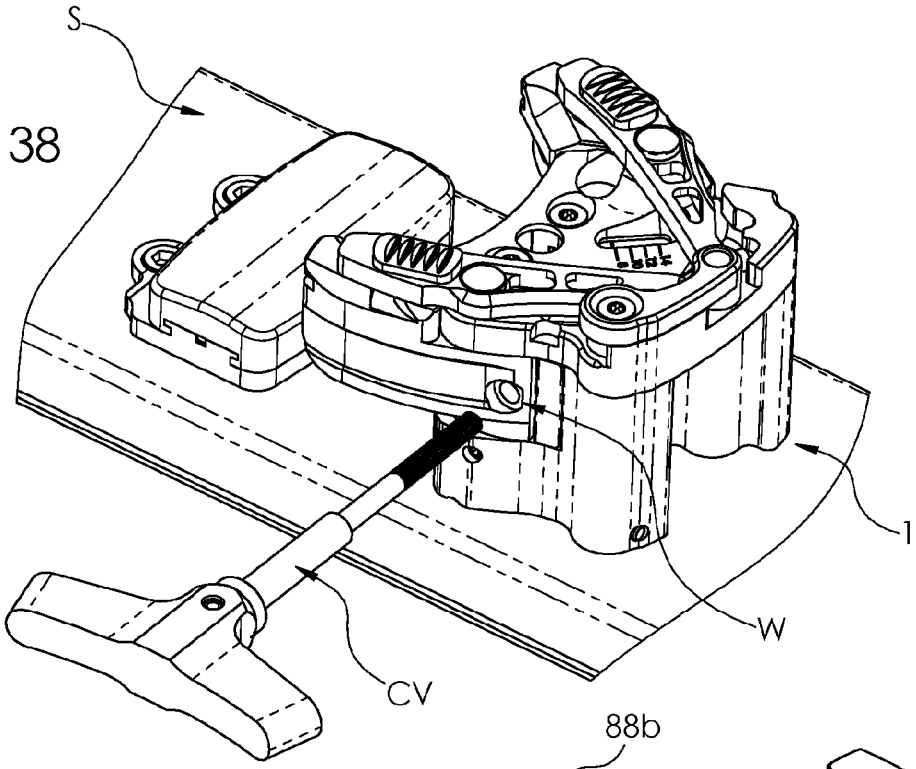
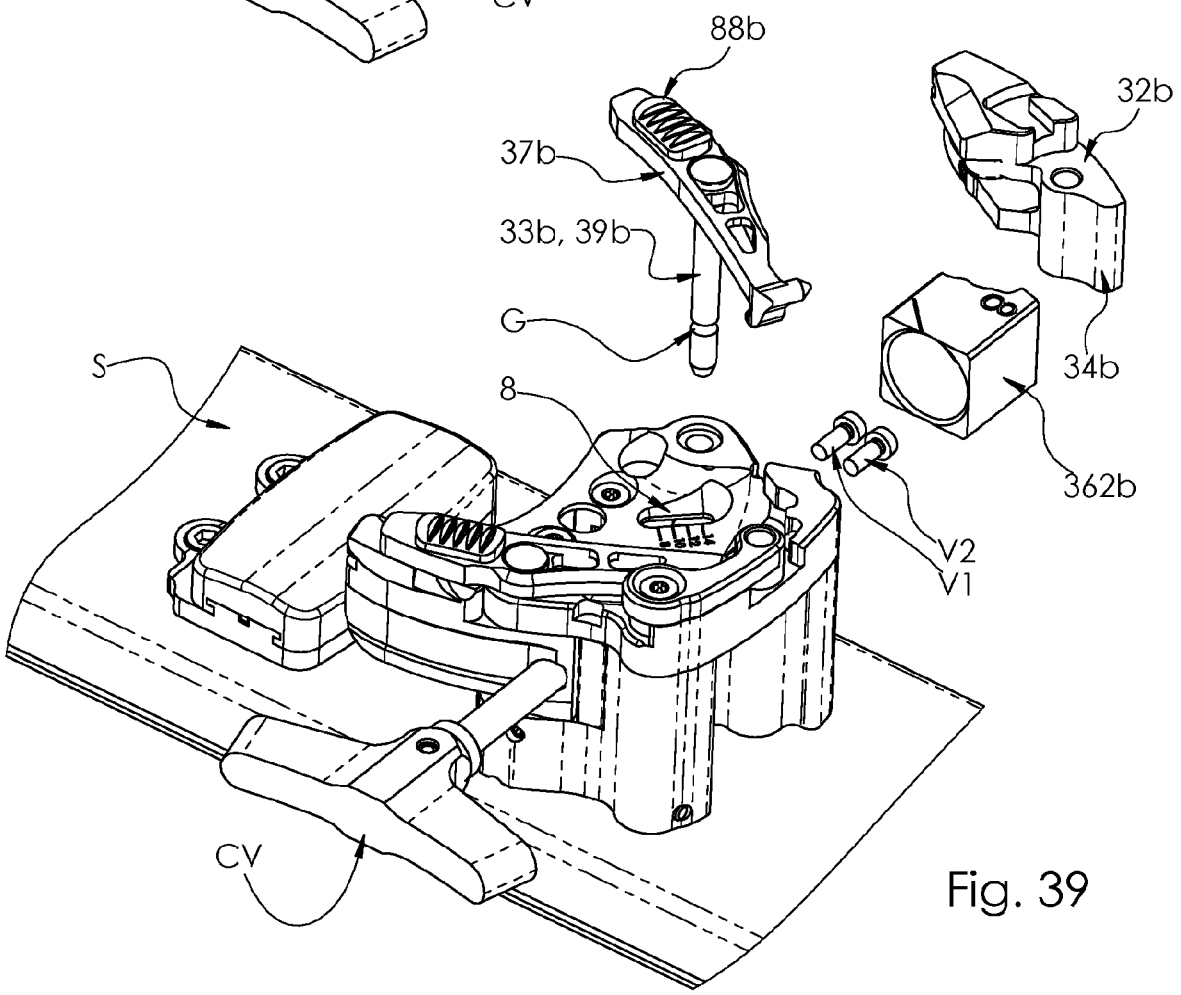
Fig. 39

SKI BINDING

TECHNICAL FIELD

The present invention relates to the field of sport accessories and more specifically to a ski binding comprising a front abutment assembly configured to allow dual practice of touring and downhill skiing with a single binding.

BACKGROUND ART

There have been attempts in the prior art to propose ski bindings adapted to the combined practice of ski touring and downhill skiing. These bindings are supposed to offer "the best of both worlds" for users, be it in terms of functionalities, security, and ease of use. Such bindings must however be integrated in a compact and light format with features specific to each of both above-mentioned skiing practices. Firstly, they must allow for rotation of the front end of a ski boot about a rotation axis transversally oriented to the longitudinal axis of a ski board holding the binding during ascending walks phases, i.e. while in ski touring mode, and secondly they must provide a firm holding of the front end of a ski boot more or less flat or parallel with the top surface of the ski board and in line with the longitudinal axis of the ski board for downhill skiing mode, with a degree of liberty in rotation or lateral translation for the front end of a ski boot in relation to the binding to allow security retention and safety release of a ski boot to avoid injuries during a fall by a user.

Such bindings necessarily require two distinct boot-retaining mechanisms integrated in a same front assembly of the binding, namely one touring boot-retaining mechanism and one downhill boot-retaining mechanism.

The touring boot-retaining mechanism usually comprises pivoting pins symmetrically arranged on opposite spring loaded jaws associated with an actuating and locking mechanism. The pins define a hinge axis for a front end of a ski boot transverse to the longitudinal axis of a ski board. The actuating and locking mechanism allows for the touring boot retaining mechanism to adopt either an engaged position, wherein the jaws are constrained towards the longitudinal axis of a ski such that the pins can fit into corresponding bearing holes in a ski boot end inserted between the jaws, or a disengaged position, wherein the jaws are open and pivoted away from the longitudinal axis of the ski board such that a user can insert or remove a ski boot front end from the touring boot-retaining mechanism.

During the ascending phases, touring boot-retaining mechanism is locked by any appropriate means in order to maintain cooperation between the pins and the boot. Without this locking, the pins may be spaced apart, causing the release of the boot from the front member of the ski binding system and potential sliding away of a ski board.

The downhill boot-retaining mechanism must ensure very good boot retention on the ski, preferably with a ski binding release in the event of a fall in order not to injure the skier. Such bindings thus comprise a lateral release mechanism associated with the pivoting of wings adapted to clamp the front end of the boot.

EP 2 626 116 illustrates a front binding member combining both boot-retaining mechanisms as described above. This solution includes a first front boot-retaining device provided for the descent and comprising two pivotable wings associated with a lateral release mechanism. The wings support interface surfaces adapted to come into contact with the front end of a ski boot nose and sole in order to vertically and laterally maintain the front end of the ski boot. This front binding also includes two pins, each being fixed on a respective extension of a wing, above the interface surfaces, each pin being integral with a wing.

Further examples of similar front binding members are also depicted in EP2944361 or EP2929918. Those bindings however show a very complex structure, and the various interrelated rotating parts, in particular the front abutment wall for downhill skiing with respect to the downhill wings and touring jaws, are difficult or sometimes impossible to manipulate by users in use, in particular with compacted and icy snow accumulating between components of the ski binding system in use.

The present invention aims at providing an alternative front ski binding assembly offering both touring and downhill skiing capabilities through the use of independent arm systems within a front ski binding assembly and a corresponding adequately designed ski boot with retaining interface surfaces.

SUMMARY OF INVENTION

The aims of the present invention are met thanks to a front binding member for a ski board as disclosed herein.

More precisely, the invention provides a front ski binding assembly for a ski board, the assembly comprising:

- a fastening platform comprising fastening means to fixedly mount said assembly on a ski board upper surface, said platform defining a longitudinal direction and a transverse direction perpendicular to the longitudinal direction;
- a front boot-retaining mechanism mounted onto said platform for retaining a user's boot in either a slope ascending or in a slope descending utilisation, said boot-retaining mechanism comprising:
  - A front boot abutment wall extending on said platform orthogonally to said longitudinal direction thereof, and
  - two first arms pivotally mounted each on a first arbor with respect to the platform and the front boot abutment wall at longitudinal ends of the front boot abutment wall,
  - a lateral security release device arranged in cooperation with first ends of the first arms to apply thereon a biasing force urging second ends of said first arms towards the longitudinal axis of the platform and to allow each of said first arms to rotate away from said longitudinal axis about its arbor upon application by a user's boot of a force higher than said biasing force on an interior surface of a said first arm and
  - two second arms pivotally mounted about second arbors, said two second arms comprising touring pins at respective ends thereof to engage corresponding mating members on front end sides of a user's boot in slope ascending utilisation, said second arms being movable between a first engaged position where the pins are engaged with such said mating members on a user's boot and a second disengaged position where the pins are disengaged from said mating members;
  - said second arms being pivotally arranged on top of said first arms and lockable in said first engaged and second disengaged positions by a locking arrangement.

The front ski binding assembly of the invention is configured for maximum ease of use and security of both ski touring and downhill skiing. The second arms are advantageously arranged over and in sliding contact with the first arms for the downhill ski mode, therefore at a most appropriate location to offer proper pivoting of a front ski boot without requiring any displacement of the first arms or the downhill ski boot abutment wall for the user between the downhill skiing mode and the touring ski mode. The shift between the two configurations is permitted only by the rotation of the second arms above the first arms. The locking arrangement then acts only on the second arms to ensure the proper engagement of the touring pins thereof with corresponding mating members of a ski boot.

A much more compact, robust, and safer front ski binding assembly that is easy to assemble, maintain, and use is thereby provided, offering uncompromised downhill skiing ski retention and ski release safety particularly for strong users skiing at high speeds, with so called "fat skis" or"freeriding skis" and/or "free touring skis".

The inventive binding assembly brings the simplest combination of necessary components with the least amount of interconnectivity of all parts to advantageously provide a user the greatest retention and release safety and redundancy in case of field icing, soiling or mechanical failure of either ski touring or downhill skiing systems.

In an embodiment, each of the two first arms is independently movable in rotation about its first arbor.

In an embodiment, each of the two second arms is independently movable in rotation about its second arbor.

This advantageously provides a total independence of the first and second arms in both downhill and touring positions, for maximum security of a user.

Preferably, the first and second arbors are a same single arbor for both the first two arms and second two arms. Alternatively, the first and second arbors are separate arbors.

In embodiments, the locking arrangement comprises a buckle pivotally arranged at one of the second arms end or on the platform to engage with the other of the second arms in both a slope ascending or in a slope descending utilisation. This offers a reliable, light weight and simple locking solution at a very affordable manufacturing price and that is easily maintainable and replaceable for the user.

Preferably, the second arms may be configured at a locking end with complementary locking means for the buckle of the locking arrangement. The complementary locking means may comprise locking notches for locking of the second arms in their disengaged position and/or serrated teeth to engage with the buckle in the engaged position of the second arms.

In a preferred embodiment, the locking arrangement comprises a locking spring pivotally arranged on said front boot-retaining mechanism to one of said second arms in a slope ascending or in a slope descending utilisation.

Preferably, the front boot-retaining mechanism and the second arms comprise locking notches for the locking spring in at least one of a slope ascending or in a slope descending utilisation.

In preferred embodiments, the locking arrangement comprises magnets to hold at least one of the second arms in at least one of a slope ascending or in a slope descending utilisation.

In embodiments of the invention, the lateral security release device comprises a compression spring exerting said biasing force against the first arms. The first arms have delimiting surfaces upon the insides of each said first arms to set a minimum U shaped geometry for a ski boot B to be retained by said delimiting surfaces of the first arms abut against an appropriate surface of the abutment wall of the fastening platform. Advantageously, the biasing force is adjustable.

In a preferred configuration, the lateral security release device comprises a set of interchangeable cams being adjustable about an end of said compression spring, said cams each defining a tubular chamber arranged for receiving said compression spring end and having a different depth to provide a varying biasing force on said compression spring. Such construction is very compact, with few pieces and easily dismountable and replaceable parts, which grants users a greatly configurable and serviceable front binding.

Preferably, the interchangeable cams each comprises a biasing force value and indicator marked on a surface and arranged to match with a graduated scale provided at a visualization window in a cover of the lateral security release device.

In a further embodiment of the front ski binding assembly, the locking arrangement comprises a spiral cam mounted to a pivot axis connected to a handle, a compression spring being coaxially mounted about the pivot axis and the spiral cam being arranged to contact a locking end of one of the second arms upon rotation of the handle towards a locking position, wherein a positive biasing of one or both of said second arms is provided by the spiral cam on at least one of the second arms.

This locking arrangement structure offers greater compactness to the front ski binding assembly altogether with improved security and ease of use for the user.

Advantageously, guiding pins are provided at a distance from each other along a length of the pivot axis to exert an increasing compressive and rotational force onto the compression spring upon rotation of the handle and linked pivot axis by a user to lock the second arms in the ski touring engaged position.

In an embodiment, the second arbor for pivoting of the second arms on top of the first arms are arranged between said touring pins and respective opposing locking ends of said second arms, said respective locking ends each comprising a biasing and locking means to lock the respective second arm in either the engaged or disengaged position. The biasing and locking means may be comprised of notches or hooks and/or serrated teeth in particular, which allow easy cooperation in locking and biasing engagement with a simple buckle formed of steel wire serving as complementary locking/biasing member.

In embodiments, the front abutment wall is immobile and fixed on the platform in all positions of the first and second arms. This ensures a permanent reference position for the user's boots, ensuring optimal comfort and security once the binding assembly is set for a determined user.

In embodiments, the first arms and lateral security release device remain operational in both the engaged and disengaged positions of the second arms. This advantageously ensures permanence of lateral security release for the user.

In an embodiment, the locking arrangement comprises a spiral cam mounted to a pivot axis connected to a handle end, a compression spring being coaxially mounted about the pivot axis and the spiral cam being arranged to contact a locking end of one of the second arms upon rotation of the handle end towards a locking position, wherein a positive biasing of one or both second arms is provided by the spiral cam on at least one of the second arms.

In such embodiment, guiding pins are provided at a distance from each other along a length of the pivot axis to exert an increasing compressive force onto the compression spring upon rotation of the handle end and linked pivot axis by a user to lock the second arms in the engaged position.

In embodiments, the second arms comprise a latch mechanism configured to connect each second arm to a respective first arm thereunder in the disengaged positions of said second arms. The latch mechanism serves to prevent impairing the lateral safety release of a user's boot in slope descending configuration. Such latching mechanism ensures optimal security in the maintenance of the positions of the second arms in relation to the first arms.

Preferably, the latch mechanism comprises a latch button solidly mounted to a cam follower and movably arranged on the second arm between a latching an locking positions, said cam follower extending toward a mating cam surface arranged in the top surface of a respective first arm, said cam surface ending in a locking notch, whereby the cam follower falls into the notch in the disengaged positions of the second arms and prevents movement thereof towards the engaged position without latching action of a user on the button.

In an embodiment, the latch button is spring loaded along a pin extending along a direction perpendicular to the second arbor of each second arms. This provides a very easy and robust construction for the latch button.

In an embodiment, the cam follower comprises a stud or pin extending perpendicularly towards the first arm thereunder.

In an embodiment, the latch mechanism is arranged to grant the second arms a degree of freedom in rotation with respect to the first arms. This controlled clearance provide mechanical play between the arms to avoid that lateral security release occur too easily during use.

Meanwhile, the first and second arms are preferably guided in rotation with respect to each other within parallel planes perpendicular to their arbors Such guidance in rotation may advantageously be achieved by means of retaining slots at an end of first arms and mating tab ridges arranged underneath the touring pins of the second arms, further preventing said second arms from being pulled excessively away from upper surfaces 58*a*, 58*b* of the first arms.

In an embodiment, biasing means are arranged between the first and second arms to return the second arms to their disengaged positions to prevent entanglement of the second arms with each other during a safety release of the first arms.

BRIEF DESCRIPTION OF DRAWINGS

Details of the invention will be better understood in view of preferred embodiments of the invention represented in the appended drawings, wherein:

FIGS. 1 to 10 represent a first embodiment of a front ski binding assembly according to the invention;

FIGS. 19 to 22 represent a third alternative embodiment of a front ski binding assembly according to the invention;

FIGS. 25 to 39 represent a fifth alternative embodiment of a front ski binding assembly;

DESCRIPTION OF EMBODIMENTS

Figure 1:
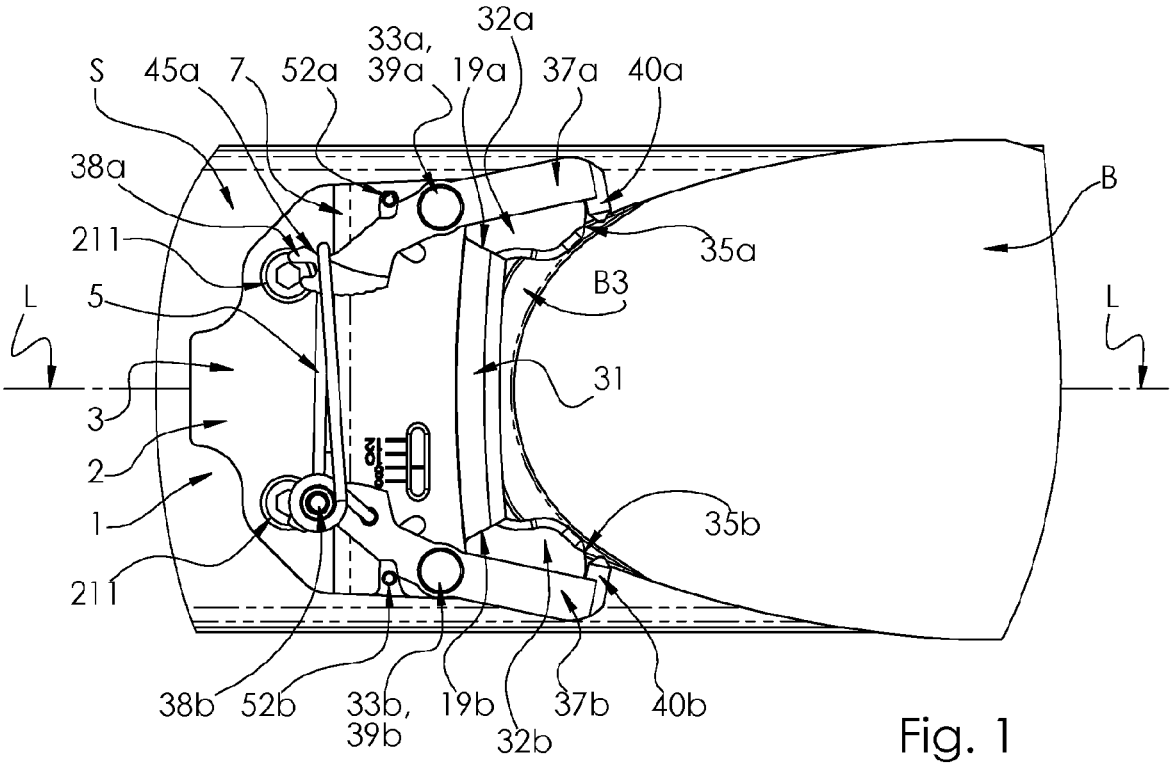

Various embodiments of a front ski binding assembly 1 according to the present invention are represented in the FIGS. 1 to 39, presenting in particular different arrangements of combined touring and downhill ski boot retaining mechanisms in a single compact and secure front ski binding assembly 1.

Common features to all embodiments of the front ski binding assembly 1 represented will be first discussed herein in relation to all figures and specific configurations and characteristics for each embodiments will then be presented in relation to the corresponding specific figures. The inventive front ski binding assembly 1 comprises a fastening platform 2 to fasten the front ski binding assembly 1 to an upper surface of a ski board S. The fastening platform 2 comprises fastening means such as screw holes 21 receiving fastening screws 211 to fit and hold the binding firmly, yet reversibly, to a ski board S. Said platform extends generally along a longitudinal direction or axis L and a transverse direction T perpendicular to the longitudinal direction L. In use, the fastening platform 2 is fastened to an upper surface of the ski board S such that the longitudinal axis L of the fastening platform 2 is parallel or superimposed to the longitudinal axis L of the ski board.

The front ski binding assembly 1 further comprises a front boot-retaining mechanism 3 mounted onto said platform 2 for retaining a user's boot B in either a slope ascending (ski touring) or in a slope descending (downhill skiing) utilisation.

The front boot-retaining mechanism 3 firstly comprises a front boot fixed or non-movable abutment wall 31 extending from said platform 2 orthogonally to said longitudinal axis L of the platform, i.e. parallel to the transverse direction T and substantially perpendicularly to the a top surface of the platform 2 opposite the ski board S in use.

The front boot-retaining mechanism 3 further comprises two first arms 32*a*, 32*b* pivotably mounted on a first arbor 33*a*, 33*b* with respect to the fastening platform 2 and front boot abutment wall 31. At a free end the first arms preferably comprise a roller R advantageously provided to help ski boot release and prevent injuries upon activation of a lateral security release device 36 described after. Said first arbor 33*a*, 33*b* for the first arms 32*a*, 32*b* is located at ends of the front boot abutment wall 31 in transversal direction T, such that they altogether define a U-shaped assembly. The first arms 32*a*, 32*b* form in all represented embodiments lateral retaining arms of the front ski binding assembly 1 in downhill skiing configuration of the binding assembly 1. With retention features to restrain ski boot toe surfaces B3 in any substantial vertical movement upwardly from the top surface of a ski board.

A lateral security release device 36 is also arranged in cooperation with first ends 34*a*, 34*b* of the first arms 32*a*, 32*b* to apply a biasing force on said first ends 34*a*, 34*b* of the first arms 32*a*, 32*b* urging the opposite ends 35*a*, 35*b* thereof towards the longitudinal axis L of the fastening platform 2

Said first arms 32*a*, 32*b* have delimiting surfaces 19*a*, 19*b* (upon the insides of each of said first arms 32*a*, 32*b*) which set a minimum U shaped geometry for the front end of a ski boot B to be received (e.g., such that the front end abuts simultaneously with the abutment wall and first arm rollers as shown in FIG. 1). Said delimiting surfaces 19*a*, 19*b* of first arms 32*a*, 32*b* abut against appropriate surfaces of both lateral ends of the abutment wall 31 of the fastening platform 2 are well known in the prior art.

Figure 9:
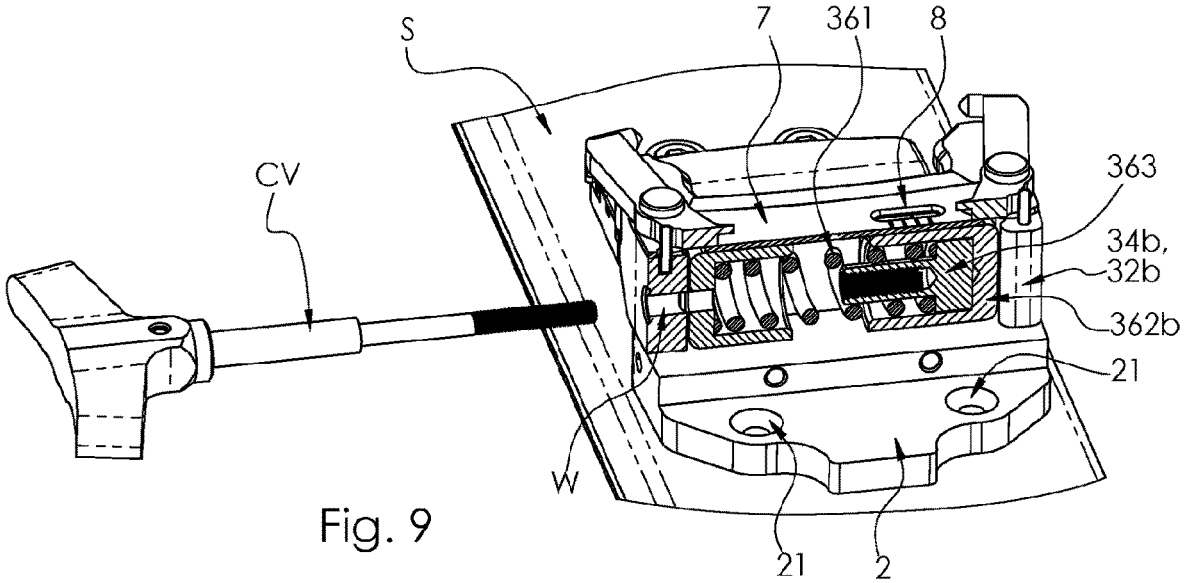

The lateral security release device 36 may be designed as represented in the drawings, in particular in FIG. 9, or in a variety of ways known in the art. Its primary and essential aim is to hold the front end B3 of a ski boot B in a central position aligned with the longitudinal axis L of the ski board S during downhill skiing but allowing each of said first arms 32*a*, 32*b* to rotate away from said longitudinal axis L of the platform 2 about its arbor 33*a*, 33*b* upon application by the user's boot B of a force higher than said biasing force on an interior surface of said first arms 32*a*, 32*b*, such as for example upon a fall of the user. Further detail of the lateral security release device can be seen in FIG. 2 where top cover 7 has been removed for clarity purpose in the representation.

As represented in FIGS. 9, 10, 28, and 34, the lateral security release device 36 is arranged in a protective cover 7 and guided therein. The protective cover 7 is preferably integrated with platform 2 and may be held in place by fastening screws or any equivalent reversible fastening means to allow servicing of the lateral security release device 36. The lateral security release device 36 comprises of a first and second cam, 362*a* and 362*b* with a helicoidal spring 361 placed in between and separated from cam 362*b* by a fixed height spring nut 363. The cams 362*a* and 362*b* directly abut on their outer ends against front ends 34*a*, 34*b* of the first arms 32*a* and 32*b* to be in a well-known fashion in order to make a safe release force for a boot. Said safe release force is advantageously adjustable through lateral displacement of the depth of the spring nut 363 contact surface within cams 362*b* along the spring's axis 361, perpendicularly to the sliding board's longitudinal axis L.

Preferably, and as is apparent from FIGS. 9, 10 and 38, 39 to set the ski boot release force a threaded tool CV, which is inserted through an access hole W in arm 32*a* see FIGS. 9, 10 and 38, 39, may be used to compress safely the release spring 361 via a spring nut 363. Once sufficient compression of spring 361 is achieved with threaded tool CV the common arbors 33*b* and 39*b* and arm 32*b* in these embodiments but not limited to becomes de-loaded and are freely removable from the front ski binding assembly 1.

Demounting the arbors 33*b*, 39*b* enables the user to interchange the cam 362*b* in order to increase or decrease the nominal safety release force with cams 362*b* of different DIN or force values. Interchangeable cams 362*b* may be provided to a user, which have varying helicoidal spring 361 and spring nut 363 hole depths in order to displace the starting compression or pretensioning of the helicoidal spring 361 within the assembly once the CV tool is removed and are preferably marked with unique force values for each cam 362*b* and have an indicator line to match with a graduated scale on cover 7.

Alternative solutions can be imagined whereby an indicator line or indicator tab geometry can be integrated directly into the spring nut 363 which directly aligns and is readable with the graduated scale on cover 7 by way of an appropriate clearance slot along the side of the interchangeable cams 362 permitting the user to read a value on the scale indicated by the spring nut 363. In normal operation of the lateral security release device 36, with the CV tool removed, the spring nut is held under constant outward force by the helicoidal spring 361 to engage both first ends 34*a*, 34*b* simultaneously of both first arms 32*a* and 32*b*.

Figure 10:
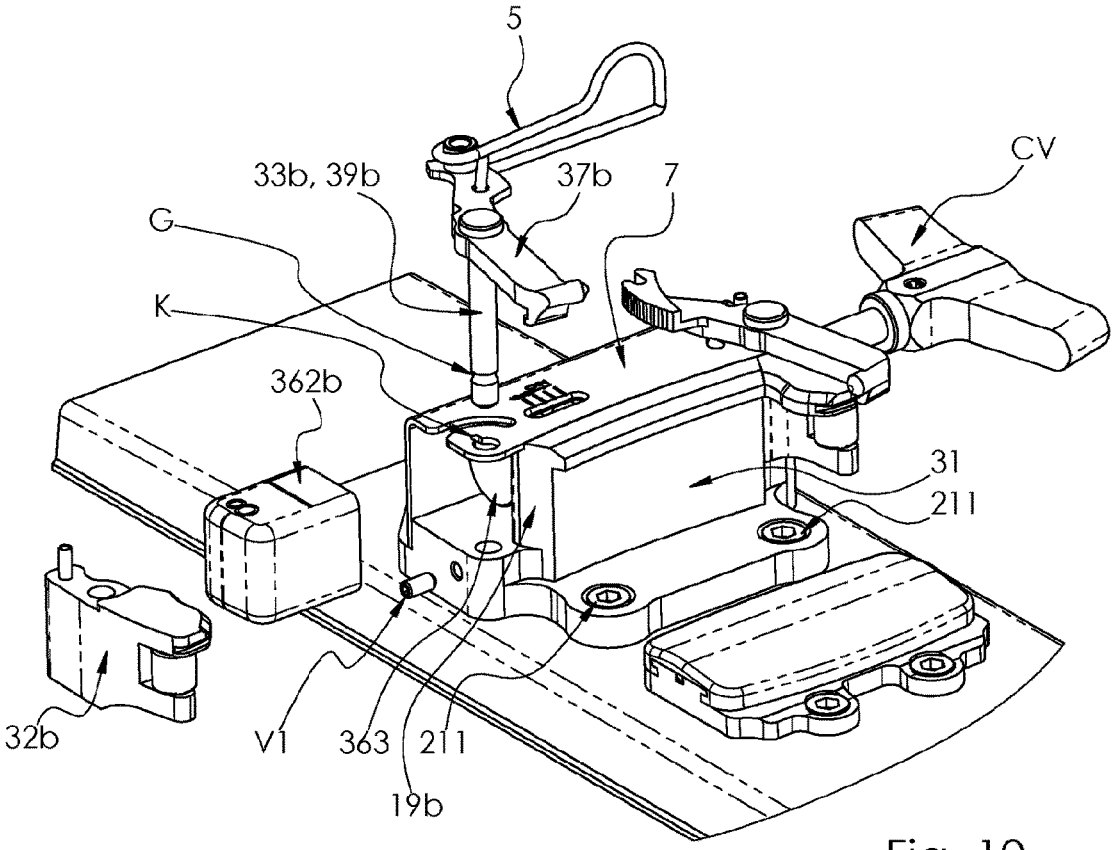

As visible in FIG. 10, the front ski binding assembly 1 can be easily and quickly dismantled to allow quick removal, cleaning and replacement of any critical elements being the arms 32*a*, 32*b*; 37*a*, 37*b*, and cams 362*a* and 362*a*, spring nut 363, arbors 33*a*, 33*b*, 39*a*, 39*b*, and safety release spring 361 for any necessary reasons.

The front ski binding assembly 1 comprises two second arms 37*a*, 37*b* pivotally mounted about second arbors 39*a*, 39*b*. The second arms 37*a*, 37*b* include touring pins 40*a*, 40*b* at respective ends thereof to engage corresponding mating members B1, B2 on the front end B3 sides of a user's boot B in ascending slope utilisation. The second arms 37*a*, 37*b* thus form in all represented embodiments lateral retaining arms of the front ski binding assembly 1 in touring skiing configuration of the binding assembly 1. The second arms 37*a*, 37*b* are movable between a first or engaged position where the touring pins 40*a*, 40*b* are engaged in such said mating members B1, B2 on a user's boot B and a second or disengaged position where the touring pins 40*a*, 40*b* are disengaged from said mating members B1, B2. Advantageously according to the proposed inventive front ski binding assembly 1, the second arms 37*a*, 37*b* are pivotally arranged on top of said the first arms 32*a*, 32*b* and lockable in said engaged and disengaged positions by a locking arrangement 5. This locking arrangement 5 is advantageously according to the proposed inventive front ski binding assembly 1 arranged within the area of the fastening platform 2 and is easily actionable manually or with the aid of a ski pole to respectively lock or unlock the second arms 37*a*, 37*b* in their engaged or disengaged positions, as described hereinafter in reference to the various embodiments of the inventive front ski binding assembly 1. A very compact arrangement of the front boot-retaining mechanism 3 is hereby provided by the proposed inventive front ski binding assembly 1, yet with total independence in rotation of the respective first arms 32*a*, 32*b* and second arms 37*a*, 37*b*.

Preferably, each of the two first arms 32*a*, 32*b* is independently movable in rotation about its first arbor 33*a*, 33*b*. Likewise, each of the two second arms 37*a*, 37*b* is independently movable in rotation about its second arbor 39*a*, 39*b*.

It will further be noted that in all embodiments of the front ski binding assembly 1 and its boot retaining mechanism 3 the first arbor 33*a*, 33*b* and second arbor 39*a*, 39*b* for the first arms 32*a*, 32*b* and second arms 37*a*, 37*b* may indifferently form a common single arbor for both the first two arms 32*a*, 32*b* and second two arms 37*a*, 37*b* or of separate arbors, either coaxial or not.

In a first embodiment of the front ski binding assembly 1 represented in FIGS. 1 to 10, the locking arrangement 5 comprises a buckle 51 pivotally mounted at one of the locking ends 38*a*, 38*b*, hereinafter referred to as locking ends 38*a*, 38*b* of the second arms 37*a*, 37*b*, located opposite the touring pins 40*a*, 40*b* respectively. The buckle 51 is fastened at a locking end 38*b* of second arm 38*b*, for example with a bolt, pin, permanently riveted or equivalent. It is further configured to engage the locking end 38*a* of the other of the second arms 37*a* in both the engaged and disengaged positions of said second arms 37*a*, 37*b*, as will be described herein after.

The locking end 38*a* shows a substantial wedge, concave, shape facing away from the longitudinal axis L, thereby forming a hook about which a free loop shaped end of the buckle 51 can be attached to bring the locking ends 38*a*, 38*b* closer together, in order to position the second arms 37*a*, 37*b* in their disengaged positions (FIGS. 1 & 5), with the touring pins 40*a*, 40*b* remote from a ski boot B front end B3 for downhill skiing utilisation.

Figure 2:
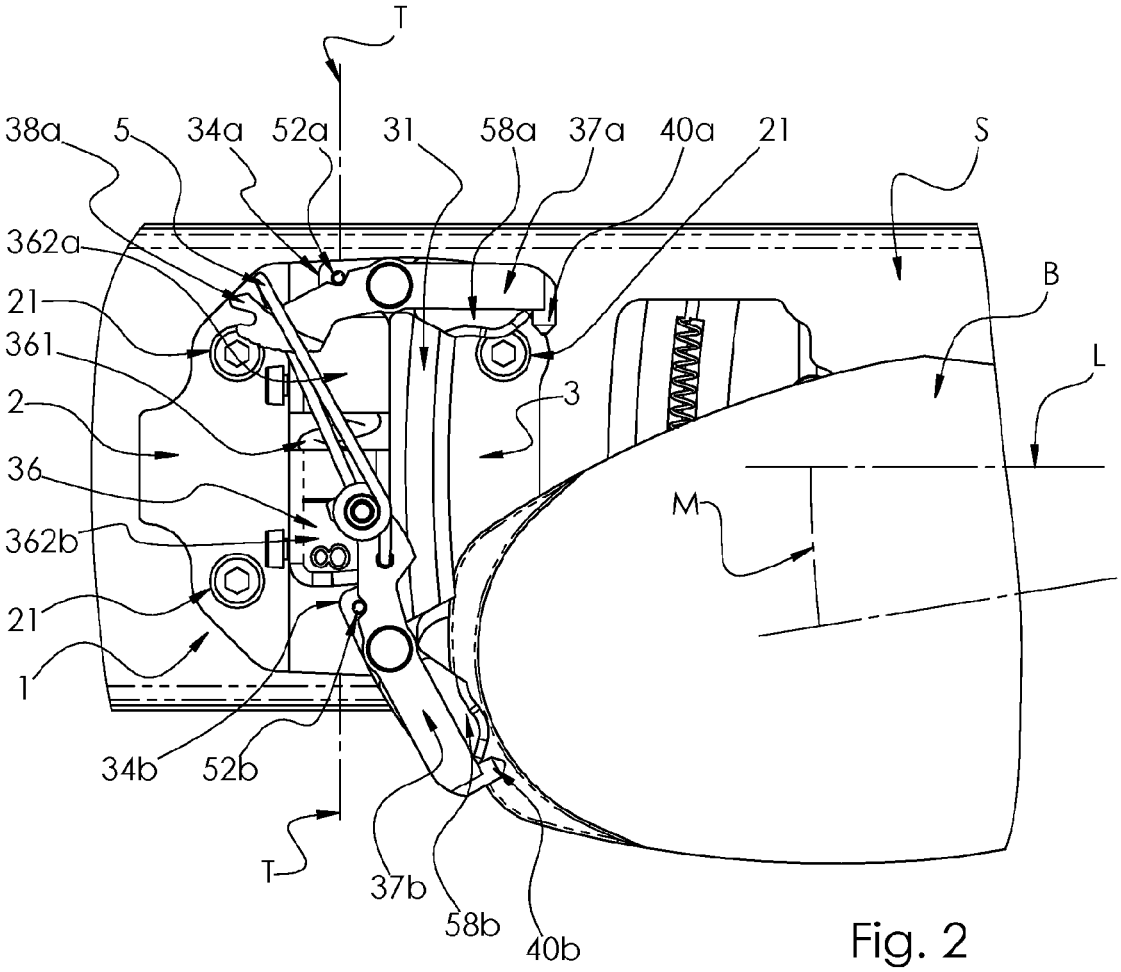
Figure 3:
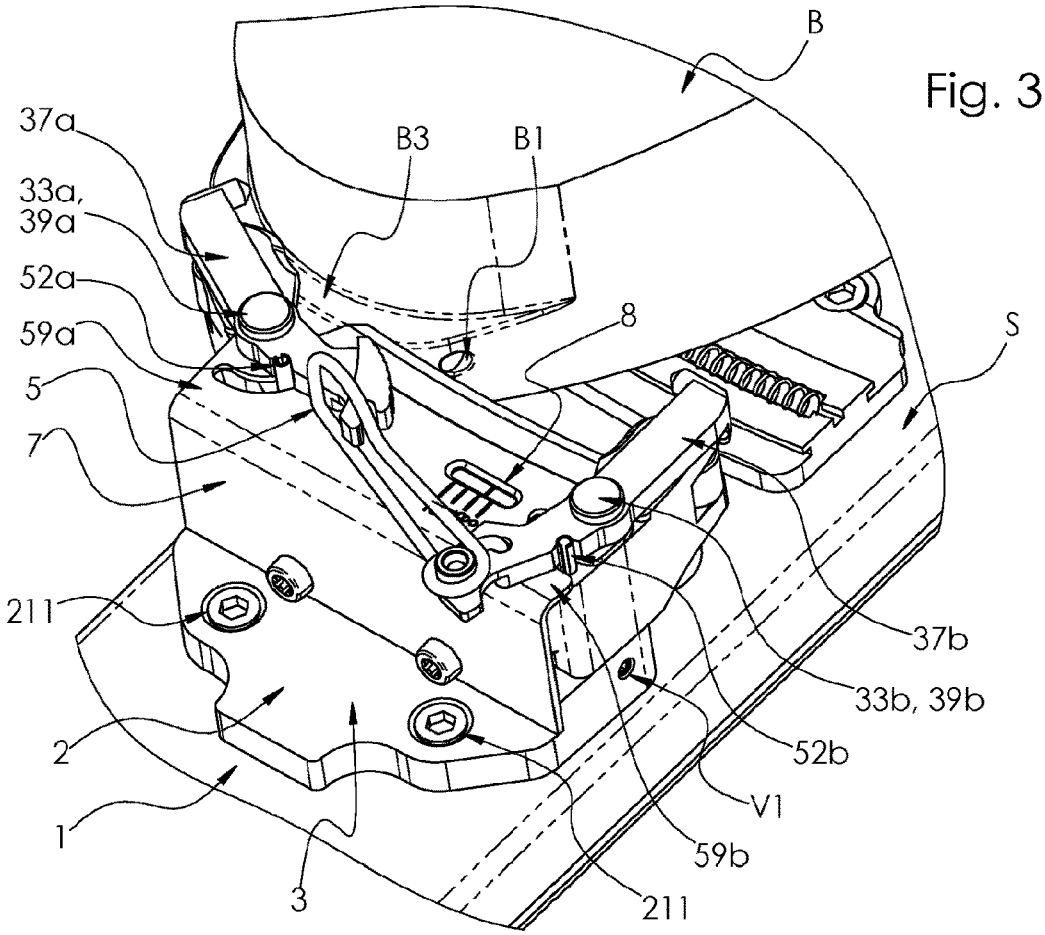
Figure 4:
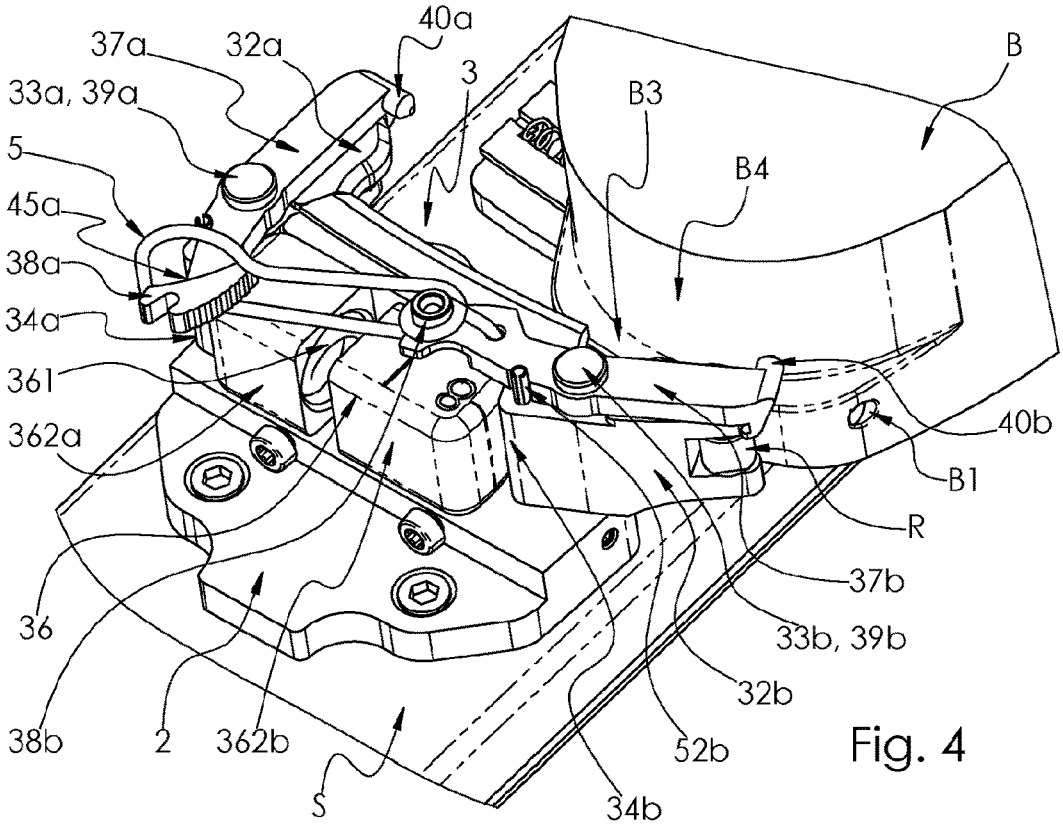

In this disengaged position, the second arms 37*a*, 37*b* should not impair the security release functionality of first arms 32*a*, 32*b* in a downhill skiing mode. To that end the front ski binding assembly 1 comprises small vertical pins 52*a*, 52*b* fixed on top of the respective first ends 34*a*, 34*b* of the first arms 32*a*, 32*b* with a given amount of mechanical clearance to a corresponding recess in each of the second arms 37*a*, 37*b* as shown in FIGS. 5 and 5A. During safety release of one of the first arms 32*a*, 32*b* in downhill ski mode, as shown in FIGS. 2 to 4, the pin 52*a*, 52*b* on that downhill retaining first arm 32*a*, 32*b* will make contact with the second arm 37*a*, 37*b* thereon and rotates it away with the same movement as the first arm 32*a*, 32*b*. Thus connecting pins 52*a*, 52*b* are necessary to allow the ski boot B to clear the front ski binding assembly 1 during safety release from downhill ski mode by keeping the touring retaining second arms 37*a*, 37*b* and their pins 40*a*, 40*b* clear of the boot B. Advantageously, biasing springs 371*a*, 371*b* are arranged or nested for example about arbors 39*a*, 39*b* of each of the two second arms 37*a*, 37*b* between said second arms 37*a*, 37*b* and an upper cover 7 of the lateral security release device 36. These biasing springs help returning said second arms 37*a*, 37*b* to their home angle J after displacement to their release angle N during a full safety release of said front ski binding assembly 1.

Locking end 38*a* of second arm 37*a* further comprises a notch, which, as shown in FIG. 6B to 7*b* advantageously serves for setting the second arms 37*a*, 37*b* in an intermediate position between the disengaged and engaged positions thereof, wherein a user can easily position mating members B1, B2 on the front end sides of a boot B in axial relationship with the touring pins 40*a*, 40*b* without having to hold the second arms in any kind of way, as shown in FIGS. 7,7*a* and 7*b* in particular.

Once, the alignment is correct, the buckle 51 can be released from the notch in locking end 38*a*, whereby the touring pins 40*a*, 40*b* are urged into the mating members B1, B2 in said ski boot B to thereby assume the engaged position of the second arms 37*a*, 38*b*, thanks to the biasing springs 371*a*, 371*b*. The biasing spring 371*a*, 371*b* applies a constant biasing force to the two second arms 37*a*, 37*b* to bring the touring pins 40*a*, 40*b* towards the longitudinal axis L, i.e. towards each other in the engaged positions of the second arms 37*a*, 37*b* for each of the pins to enter respective corresponding mating members B1, B2 on the front end sides of a user's boot B as shown in FIGS. 7 to 8 and described below. The buckle 51 then also serves as locking member in the engaged position of the second arms 37*a*, 37*b*. This locking function is achieved by the natural urging of the free end of the buckle 51 against serrated teeth 53 provided on a convex or appropriately angled inner face of the locking end 38*a* of touring arm 37*a* in this configuration arrangement. Serrated teeth 53 advantageously prevent the buckle 51 from slipping at the locking end 38*a* when the buckle 51 is urged and/or manually pressed against it. It also provides an automatic and inherent adjustment feature/functionality for varying widths or depths of the touring pin 40*a*, 40*b* mating with members B1, B2 on different ski boots B associated with wear or varying designs or manufactured tolerances from various ski boot manufactures.

As represented in FIG. 6A, 6B in details, the second arms 37*a*, 37*b* are arranged on top of the first arms 32*a*, 32*b* and a lateral rigidity system is provided to prevent lower surfaces 54*a*, 54*b* of the second-arms 37*a*, 37*b* from being separated excessively from upper surfaces 58*a*, 58*b* of the first arms 32*a*, 32*b* or levered excessively against cover surfaces 59*a*, 59*b* of cover 7 by arbors heads of arbors 39*a*, 39*b*.

When the second arms 37*a*, 37*b* are in the engaged positions and a skier is walking with his ski boot B locked in the binding assembly 1 by the locking arrangement 5, a percentage of the skier's weight is passed from the ski boot B to the touring pins 40*a*, 40*b*. This force in the direction of the skiing board S is then transmitted to the upper surfaces 58*a*, 58*b* of the first arms 32*a*, 32*b* from the lower surfaces 54*a*, 54*b* of the second arms 37*a*, 37*b*.

In typical use when the skier is in a touring skiing utilisation he makes forward progress by alternately lifting or releasing his weight from one ski boot B at a time to step forward with his other ski boot, in doing so the front ski binding assembly 1 attached to ski board S and engaged to the skiers boots B experiences a reversing force from the skier's ski boot B which tends to pull the touring pins 40*a*, 40*b* away from the top surface of the skiing board S. Upper ends of the first arms 32*a*, 32*b* include retaining slots 55*a*, 55*b* having upper surfaces 57*a*, 57*b* (FIG. 28) that are shaped and dimensioned to engage mating tab ridges 56*a*, 56*b* below the touring pins 40*a*, 40*b* of the second arms 37*a*, 37*b*, respectively, to prevent said second arms 37*a*, 37*b* from being be pulled excessively away from the upper surfaces 58*a*, 58*b* of first arms 32*a*, 32*b*. As represented in FIG. 6*a* in details. Without these restraining features part breakages within the front ski binding assembly 1 could be possible in certain circumstances.

Retaining slots 55*a*, 55*b* and ridges 56*a*, 56*b* further cooperate in such a way that the second arms 37*a*, 37*b* pass radially through unimpeded in a perpendicular plan to the axis of arbors 39*a*, 39*b*. However, when a load that is applied parallel to the arbors 39*a*, 39*b* any mechanical clearances either between lower surfaces 54*a*, 54*b* and 58*a*, 58*b* and cover surfaces 59*a*, 59*b* and ridges 56*a*, 56*b* will quickly constrain the upper and lower heights of the touring pins 40*a*, 40*b* from the top surface of the skiing board. Sufficient mechanical clearance is available between ridges 56*a*, 56*b* and surfaces 57*a*, 57*b* to allow the second arms 40*a*, 40*b* to return unimpeded to their disengaged position for downhill skiing utilisation.

As represented in FIG. 10, the common arbors 33*a*, 39*a*, 33*b*, 39*b* can be dismounted allowing for servicing the front ski binding assembly 1 and replacing parts thereof. They are fastened to the protection casing by means of removable screws V1, V2 which engage in a groove G and restrain axe arbors 33*a*, 39*a*, 33*b*, 39*b* from becoming displaced or disassembled from the front ski binding assembly 1 during use.

As an alternative means to restraining the common arbors 33*a*, 39*a*, 33*b*, 39*b* from being displaced or disassembled during use without the use of removable screws V1, V2 one can imagine an obround shaped hole of an appropriate width to correspond to the diameter of said arbor with at least one end coaxially aligned with a corresponding round or obround shaped hole in a second restraining position as per imagined in the cover 7 of all embodiments shown in FIGS. 1 to 39. Said obround hole is elongated in the direction of the second arbor hole within the fastening platform 2. The mating arbor has a similar groove Gas presented in FIG. 10 but instead of removable screws V1, V2 locating into said groove G a non-removable cylindrical or otherwise appropriately profiled pin to mate with the profile of the groove G is arranged more or less transverse to the working axis of spring 361 axis of the lateral security release device 36 and traverses inside sufficiently the obround hole. Thus when the arbors are under a lateral displace force by lateral security release device 36 the arbor located within the obround hole is forced outwardly to the limits of the obround hole and the aforementioned imagined non-removable or fixed pin and groove G of arbors 39*a*, 39*b* become sufficiently engaged to prevent any unwanted displacement of the said arbor within the fastening platform 2 during use. Whenever the user wishes to disassemble said arbor from the fixed pin arrangement, he/she simply compresses the lateral security release device 36 to remove the outward forces acting upon said arbors until said arbor becomes sufficiently unloaded and loose within the obround hole to disengage the arbor groove G from the fixed pin by the increased mechanical clearances given thanks to the imagined obround hole, a slight tilting of the arbor away from the fixed pin in embodiments where only one obround hole is utilised in conjunction with an opposing round hole to locate a single arbors.

FIGS. 11 to 14 represent a first alternative embodiment to that of FIGS. 1 to 10 previously described. In this embodiment the second arms 37*a*, 37*b* are identical to each other in such a way that all key functional geometry is mirrored from 1 second arm 37*a*, 37*b* to other said second arm 37*a*, 37*b* and the buckle 51 this alternative embodiment is pivotally mounted in holes formed in upwardly extending aisles on the platform 2 with a freedom of rotation in a forward and rearward manor more or less parallel to the longitudinal axis L and with an integrated spring loading providing a natural urging of the buckle 51 rearwards towards the front end B3 of a ski boot B. Advantageously in alternative embodiment the buckle biases more or less equally both locking ends 38*a* and 38*b* of the second arms more or less simultaneously with any displacement of buckle 51.

Figure 11:
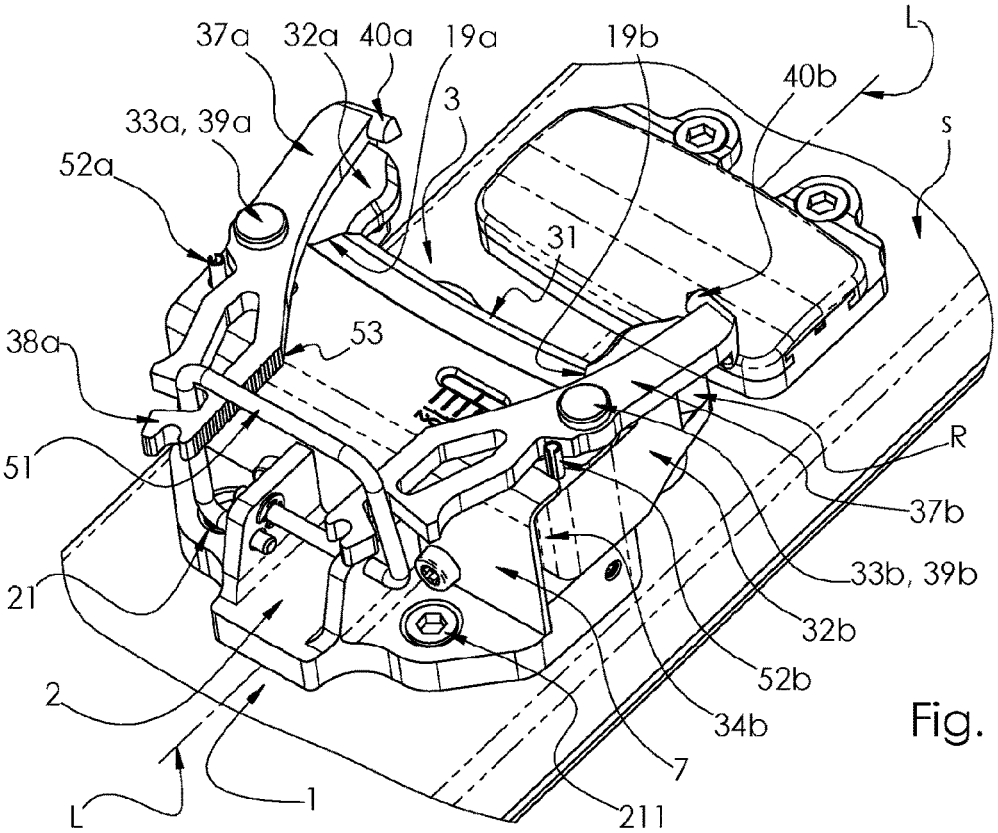
FIGS. 11 to 14 represent a first alternative embodiment of a front ski binding assembly according to the invention.
Figure 12:
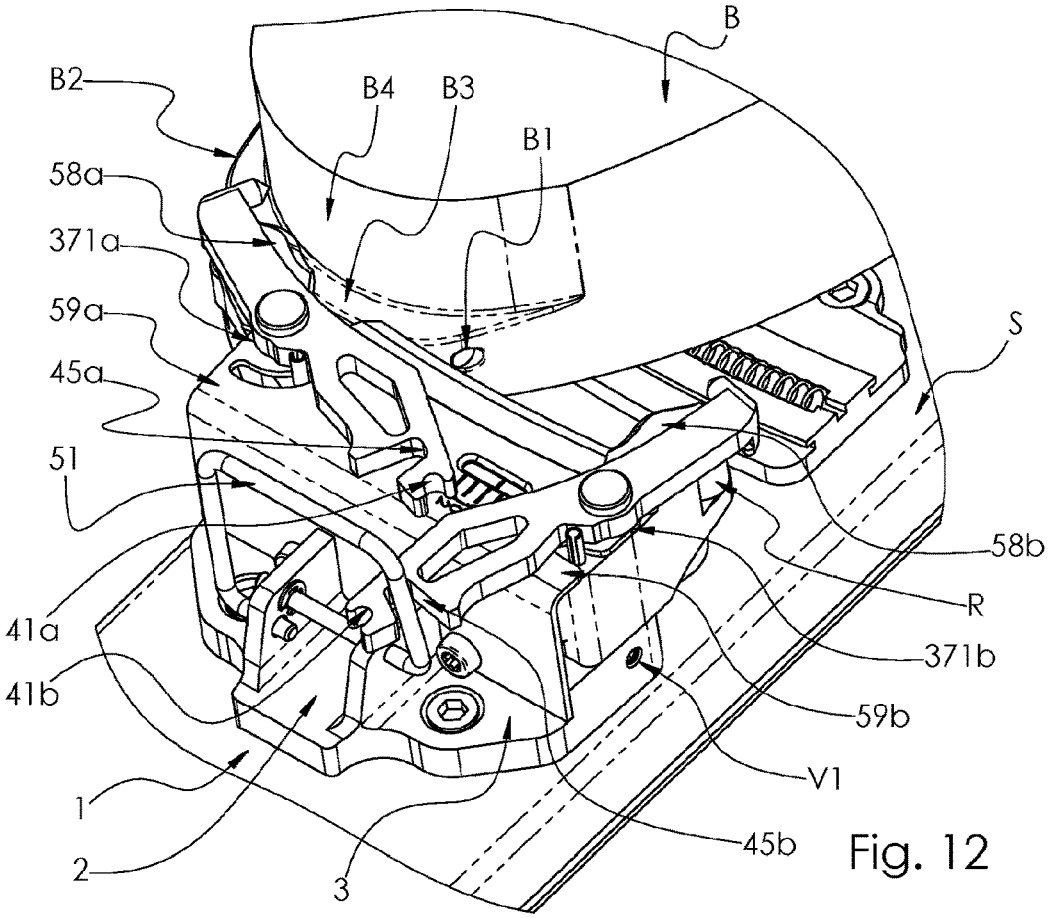
Figure 13:
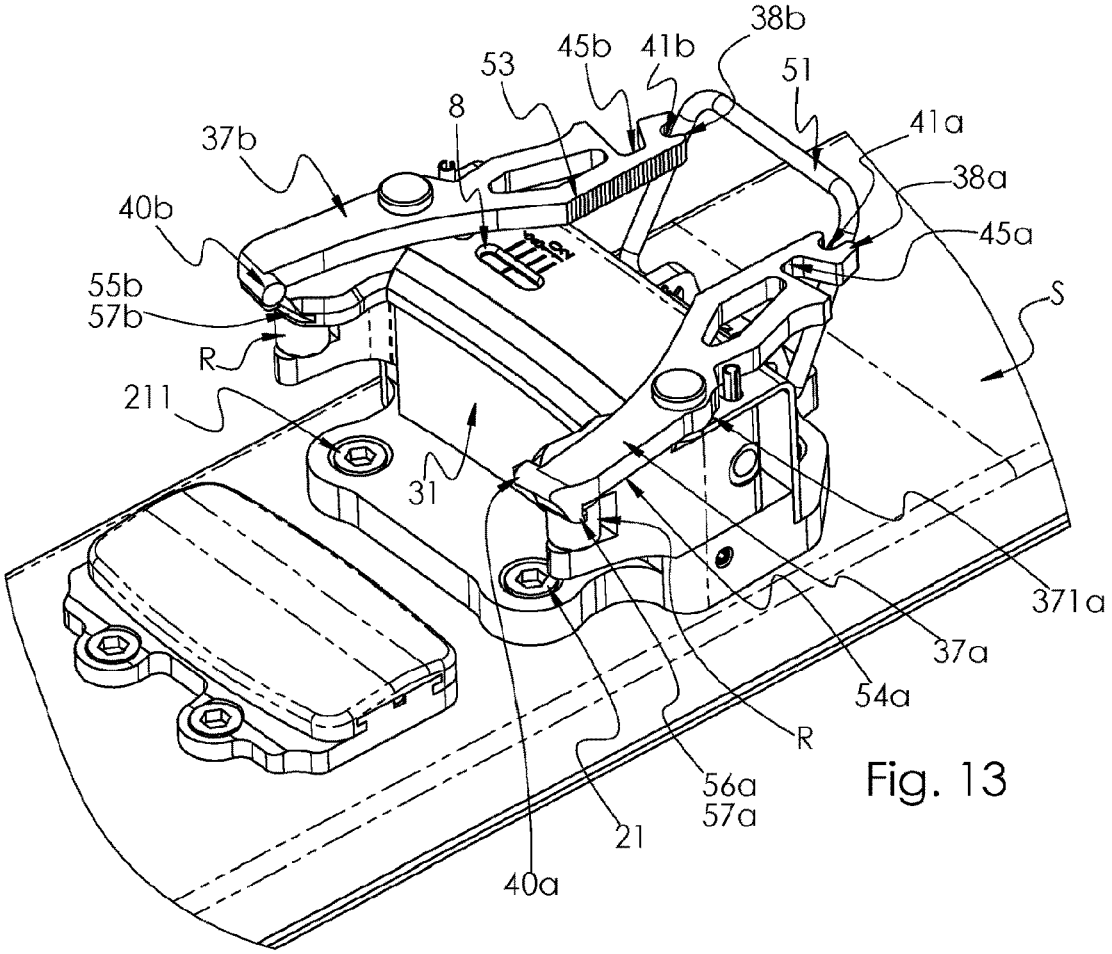
Figure 14:
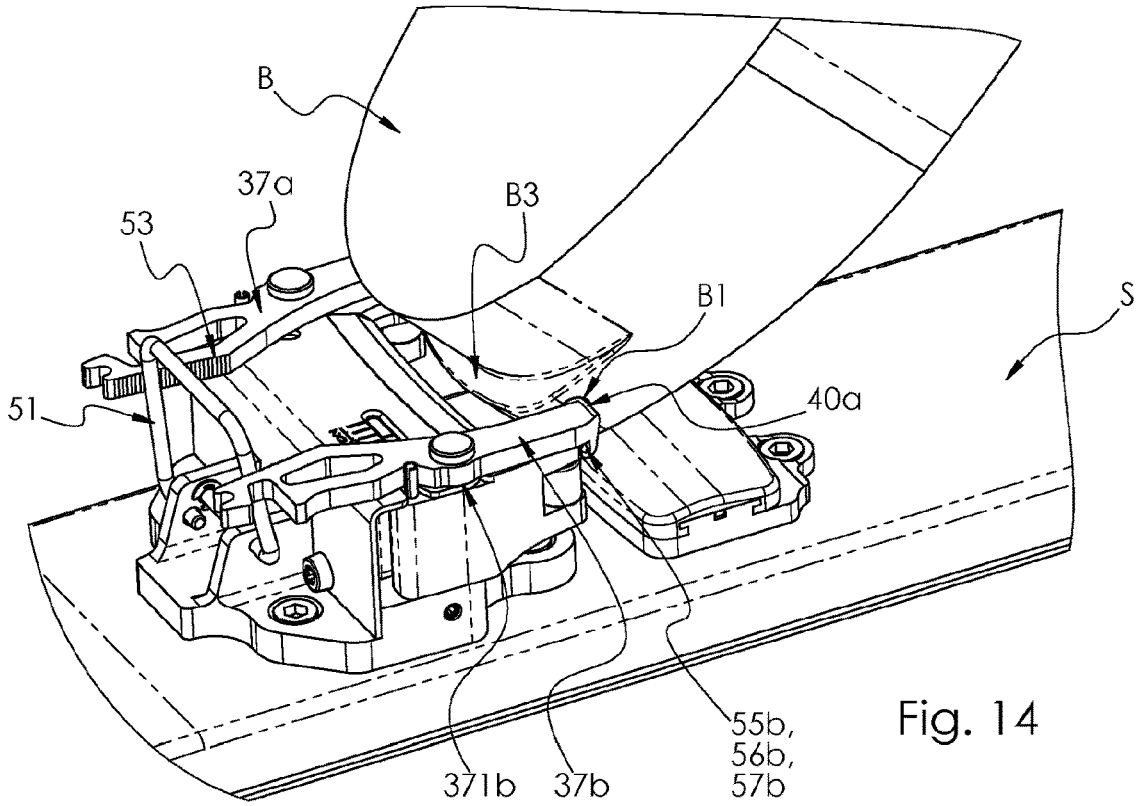

The second arms 37*a*, 37*b* comprise at their locking ends 38*a*, 38*b* lateral notches 45*a*, 45*b* arranged for receiving the buckle 51 in the disengaged position, as shown in FIG. 11 of the second arms 37*a*, 37*b*. They also each show a front notch 41*a*, 41*b* serving to accommodate the buckle 51 in an intermediate setting position as shown in FIG. 13 of the second arms 37*a*, 37*b*, thus leaving the touring pins 40*a*, 40*b* sufficiently spaced apart so that a user can enter a front end B3 of a boot B and align the touring pins 40*a*, 40*b* with corresponding mating members B1, B2 of a ski boot before engaging the second arms 37*a*, 37*b* into their respective engaged positions. As shown in FIG. 14, the touring pins form a transverse to the longitudinal axis L hinging axis for the practice of ski touring as shown in FIG. 14. When the second arms 37*a*, 37*b* are in the engaged position shown in FIG. 14, the buckle 51 is allowed to engage on inner side faces of the locking ends 38*a*, 38*b* of the second arms 37*a*, 37*b* comprising serrated teeth 53, thereby locking the second arms 37*a*, 37*b* in their engaged positions. The serrated teeth 53 prevent any unwanted reversing or slipping of the buckle 51 from its engagement in the engaged position of the second arms 37*a* and 37*b*, the buckle 51 with its spring loaded urging in this alternative embodiment is mounted in non-coaxial holes designed to twist the buckle 51 and generate a spring loaded force as commonly known with climbing carabiners for example.

In the embodiment shown in FIGS. 11 to 14, it is self-evident that each of the second arms 37*a*, 37*b*, and the buckle 51 are configured to assume a locking engagement via surfaces shown with serrated teeth 53 in FIGS. 11 to 14, which are preferably similarly convex or have appropriately angled inner face to create a biasing of touring pins 40*a*, 40*b* ends towards the longitudinal axis L and thus provide a means of entering, locking and disengaging said touring pins 40*a* and 40*b* from corresponding features B1, B2 in the front end B3 of a ski boot B. However it is also possible to imagine alternative configurations to replace the represented buckle 51 that similarly provide the same key advantage that the buckle 51 shown in FIGS. 11 to 14 has over the buckle shown in the first embodiment per FIGS. 1 to 10, said key advantage is the simultaneous and equal biasing of both of the second arms 37*a* and 37*b*. One obvious alternative configuration could be to replace said buckle 51 with a rotating arbor transversal and perpendicular to the longitudinal axis L and roughly parallel to the top surface of a ski board also pivotally mounted in holes formed in upwardly extending aisles on the fastening platform 2 with a freedom of movement forward and rearward parallel to the longitudinal axis L and preferably with a torsional spring providing a urging in one or another direction about its axis with a minimum of 2 shortened pins or features protruding and appropriately placed along said arbor and perpendicular to the axis of said arbor to simultaneously engage both locking ends 38*a* and 38*b* of the second arms 37*a* and 37*b*. It can also be imagined that with an appropriately shaped cam surface placed at the locking ends 38*a* and 38*b* and mirrored about a plane perpendicular to the top surface of the ski and parallel with the longitudinal axis L of said second arms 37*a* and 37*b* have either a compound angle planar surfaces or a helicoidal surface geometry present that would bias the second arms and associated touring pin 40*a* and 40*b* towards their respective corresponding features B1 and B2 of the toe end of a ski boot with a rotary action of said arbor. One can also imagine a lever fixedly fixed to said rotating arbor for a user to press or pull upon to employ said alternative configuration to activate and deactivate the second arms 37*a* and 37*b*. Conversely as previously said a helicoidal geometry can be axially arranged about previously said rotating arbor and mirrored about previously said reference planes so that an opposing helix form can simultaneously engage previously said locking ends 38*a* and 38*b* of second arms 37*a* and 37*b* to simultaneously bias opposing touring pins 40*a* and 40*b* into corresponding features B1 and B2 of the toe end of a ski boot B.

Further to the embodiment of FIGS. 1 to 10 this alternative embodiment shown in FIGS. 11 to 14 retains all said features described in the embodiment and figures of 1 to 10 plus all further described alternative embodiments including those related to alternatives to a buckle 51 of the locking arrangement 5 associated with second arms 37*a*, 37*b* as described in the above.

Figure 15:
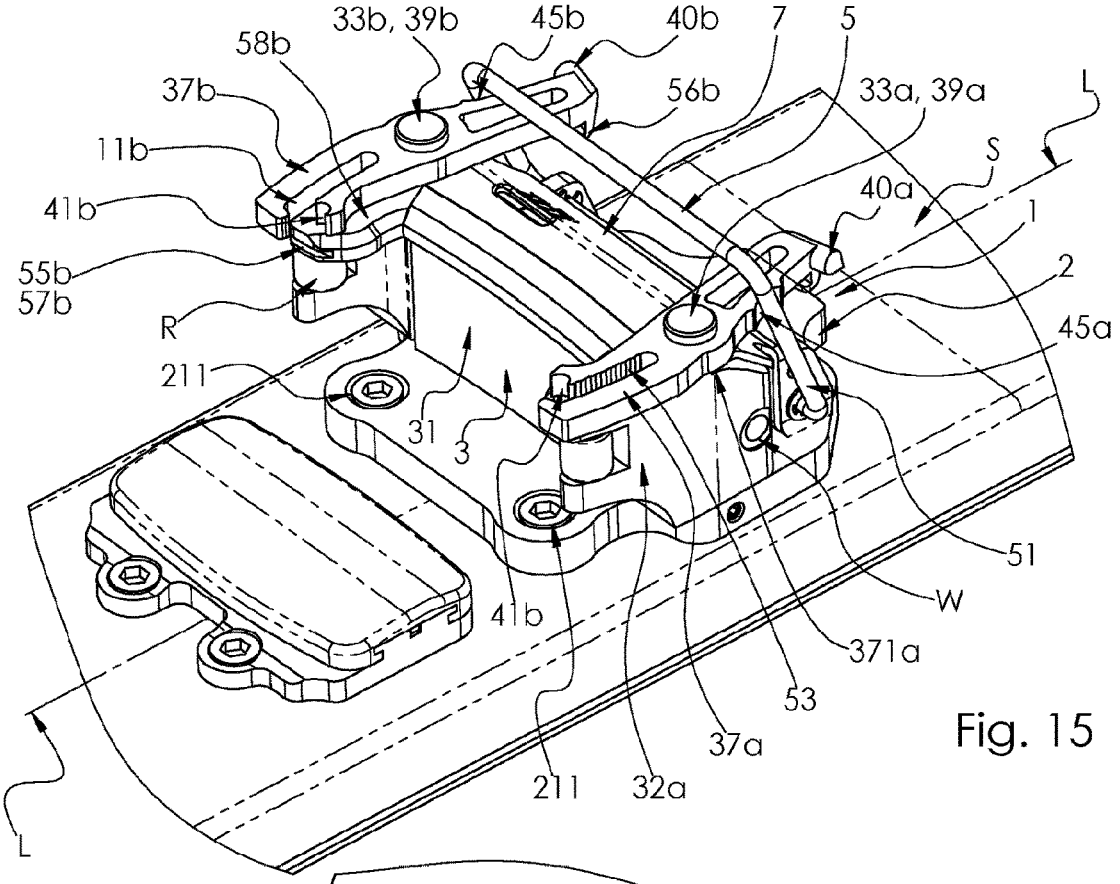
FIGS. 15 to 18 represent a second alternative embodiment of a front ski binding assembly according to the invention.
Figure 16:
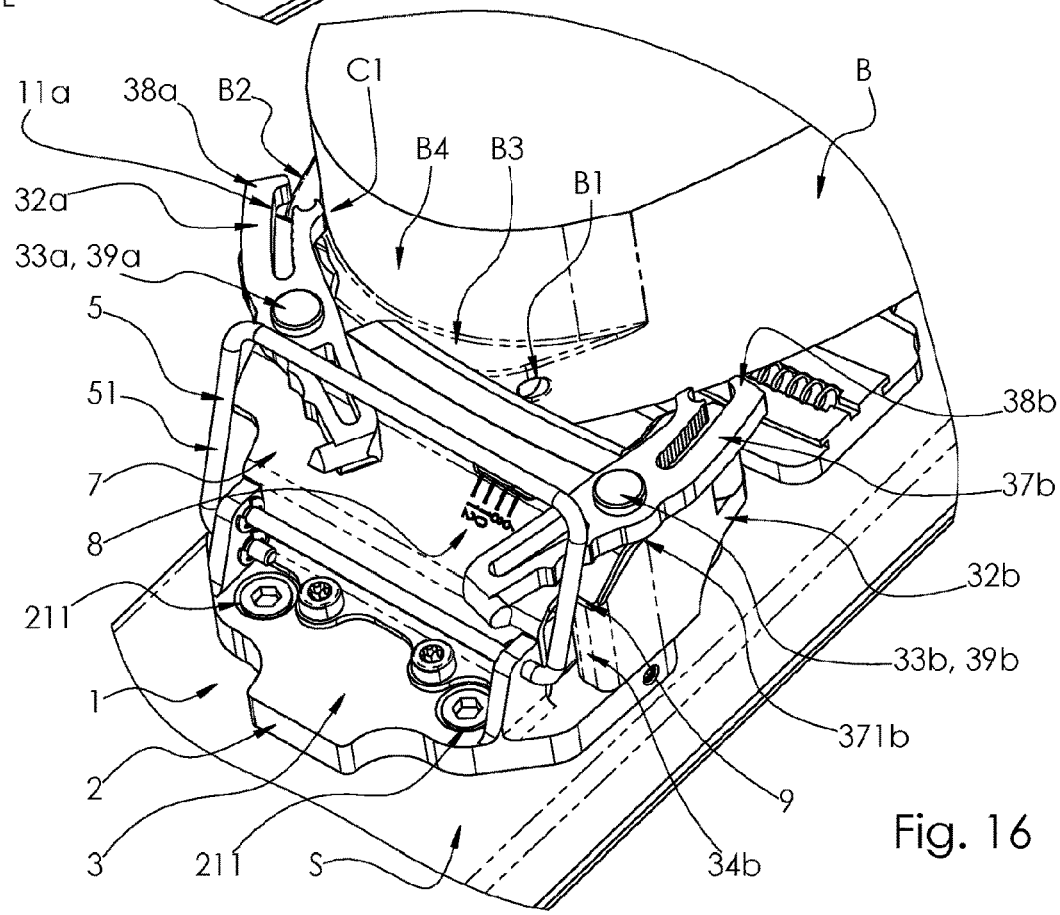
Figure 17:
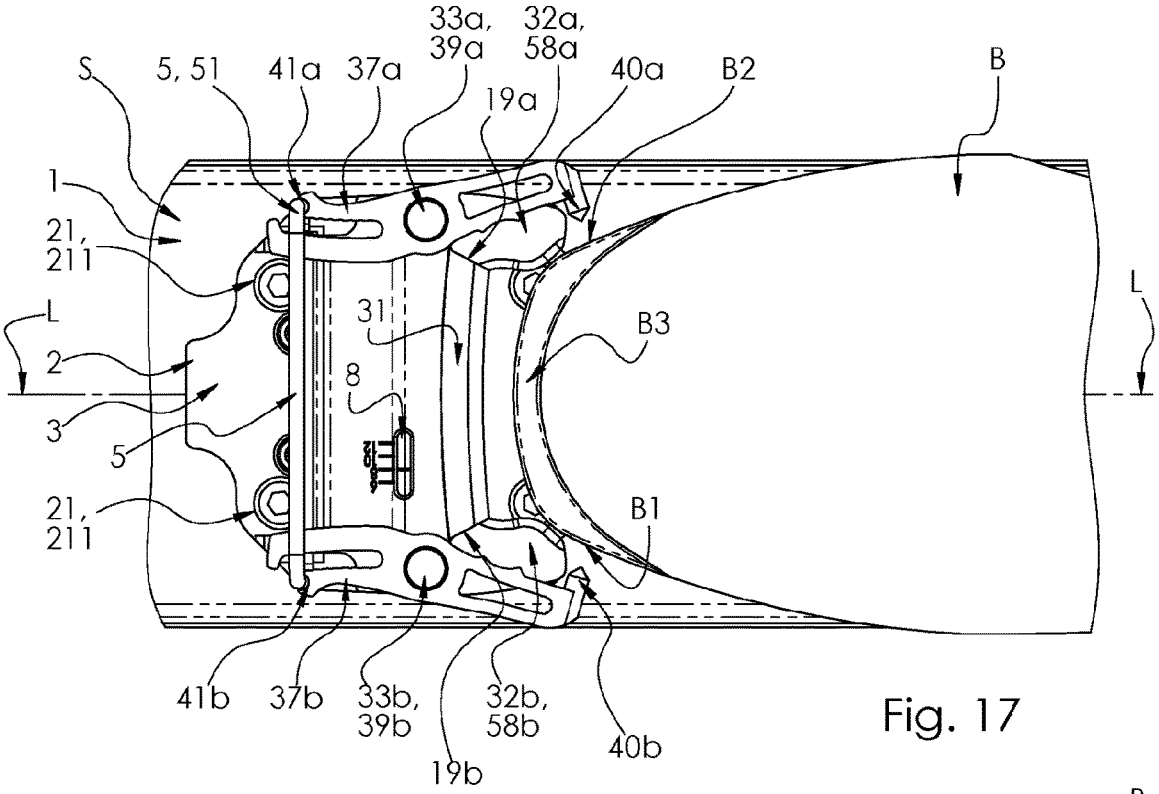
Figure 18:
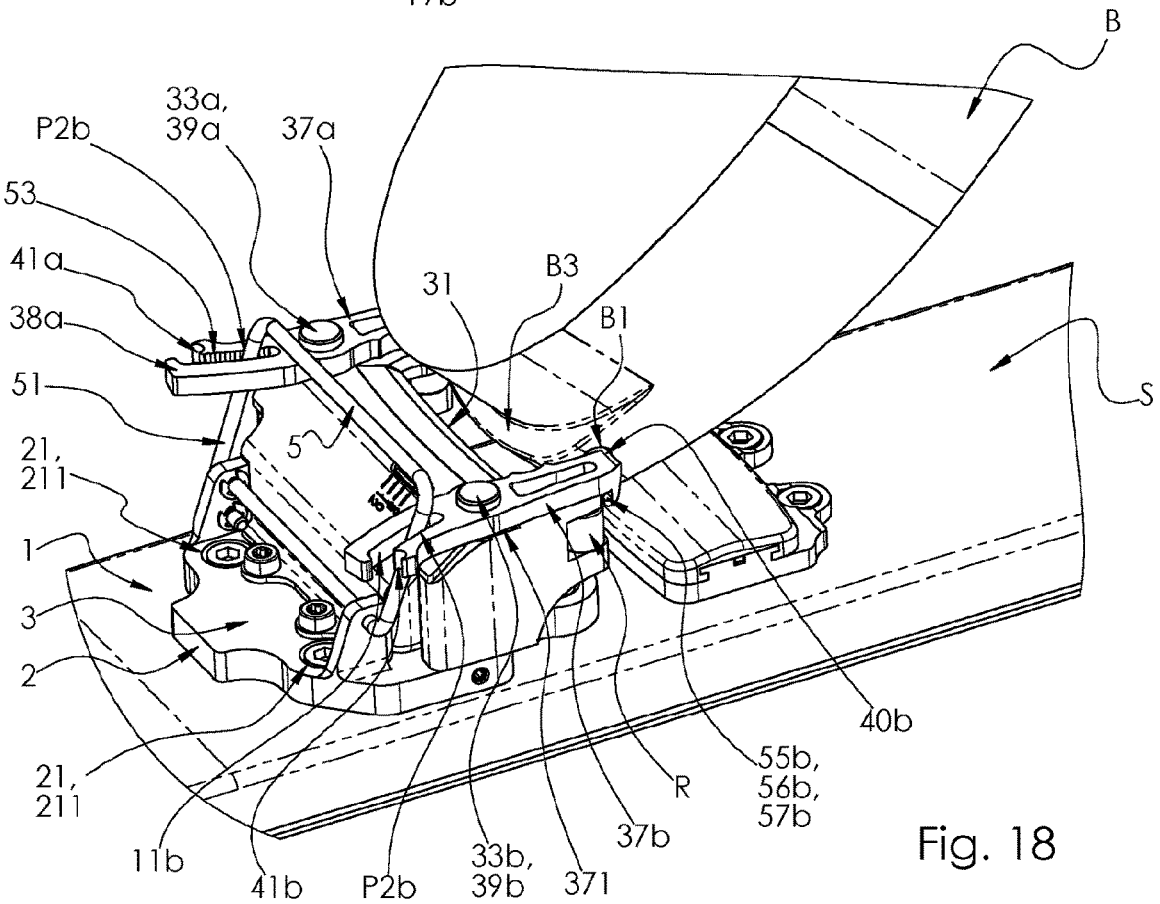

FIGS. 15 to 18 further represent a second alternative embodiment to that of FIGS. 1 to 10, wherein the locking ends 38*a*, 38*b* of the second arms 37*a*, 37*b* adopt a fork shape with a central longitudinally extending notch defining two teeth of the fork. The buckle 51 is pivotally mounted to the platform 2 as in the previous embodiment but with a larger clearance between side branches of the buckle 51 such that in the disengaged position, shown in FIGS. 15 to 16 the touring pins 40*a*, 40*b* are fully pivoted frontward to the front ski binding assembly 1 and locked in position by insertion or reception of the side branches of the buckle 51 in notches or recesses of lateral 45*a*, 45*b*. Then in the engaged position the touring pins 40*a*, 40*b* are pivoted about arbors 39*a*, 39*b* substantially through a greater angular rotation of 90° and less than 359° towards the longitudinal axis L of the binding and they are locked in the engaged position by sliding the said side branches of the buckle 51 in the forks' central notches, whereby an inner surface of one of the branches of the forks is comprised of serrated teeth 53. Intermediate setting position of the touring pins 40*a*, 40*b* can further be held by clipping the buckle 51 into locking recesses 41*a*, 41*b* at an end of one of the forks' teeth as shown in FIG. 17. Further alternatives to the represented buckle 51 can be imagined, namely the alternative transversal arbor with said protruding dowel pins or a mirrored helicoidal geometry that can operate within the previously described adopted fork shape with a central longitudinally extending notch defining two teeth of the fork. As previously said an arbor type alternative that simultaneously engages and biases said second arms in a manor to engage with corresponding ski boot B features B1 and B2 are herein protected.

FIGS. 19 to 22*a* further represent a third alternative embodiment to that of FIGS. 1 to 10, in this embodiment, an upper cover 7 of the protection casing for the security release mechanism 36 is further delimiting a hiding recess for the touring pins 40*a*, 40*b* when the second arms 37*a*, 37*b* are pivoted frontwards into a ski touring inactivated position, as similarly presented in FIGS. 15 to 16 of previous embodiment presented in FIGS. 15 to 18.

In this disengaged position the second arms 37*a*, 37*b* as shown in FIGS. 19 and 20 the downhill skiing arms that do not have a disengaged position are freely accessible for a front end B3 of a ski boot B to be inserted into the first arms 32*a*, 32*b*. In such disengaged position the second arms 37*a*, 37*b* and touring pins 40*a*, 40*b* are retained within the cover 7 by means of magnets 61 fixedly arranged in the frontward protection casing or the cover 7 (see FIG. 20, where top cover 7 has been removed for clarity purpose in the representation).

The first arms 32*a*, 32*b* and second arms 37*a*, 37*b* are pivotable about a common arbor 33*a*, 39*a*, 33*b*, 39*b* these said arbors are considered vertical or near vertical to the upper surface of a ski board S such that they create a closing movement transversely across the longitudinal axe of the ski board S. In the FIGS. 19 to 22*a* these arbors for the first arms 32*a*, 32*b* and second arms 37*a*, 37*b* are drawn as common for both said arms but any like arrangement acting as a fulcrum point for two independent first arms 32*a*, 32*b* and two second arms 37*a*, 37*b* are feasibly for all embodiments within FIGS. 1 to 39.

Figure 21:
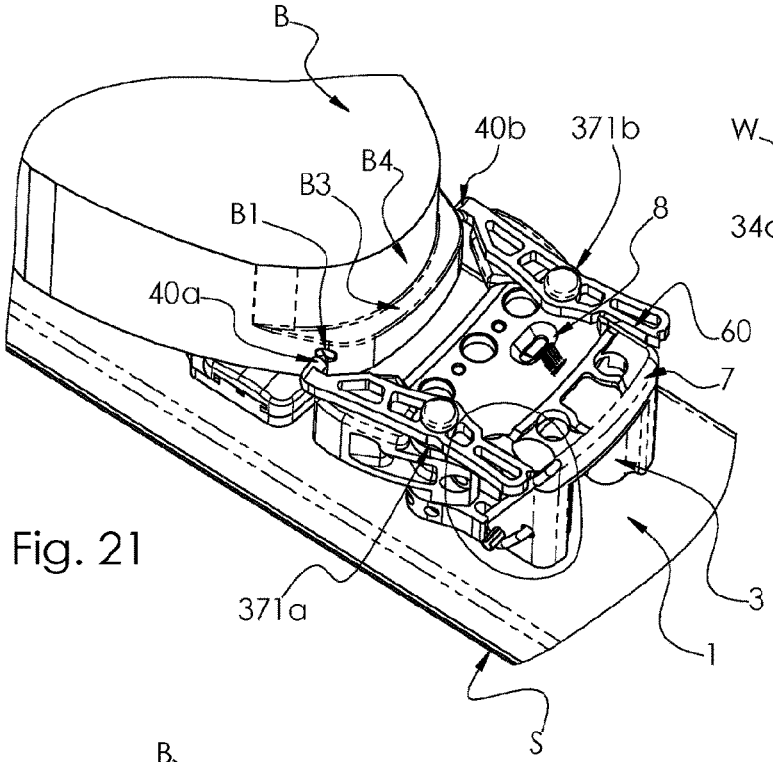
Figure 21A:
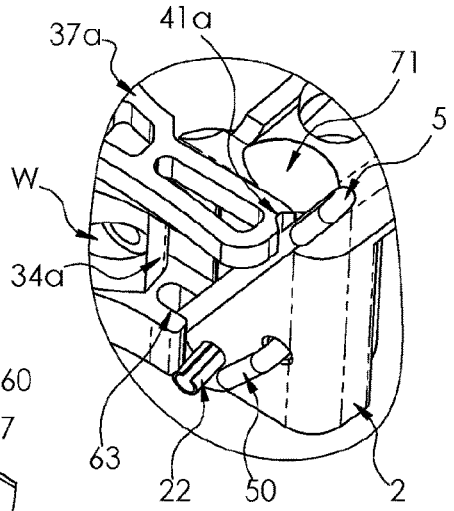
Figure 22:
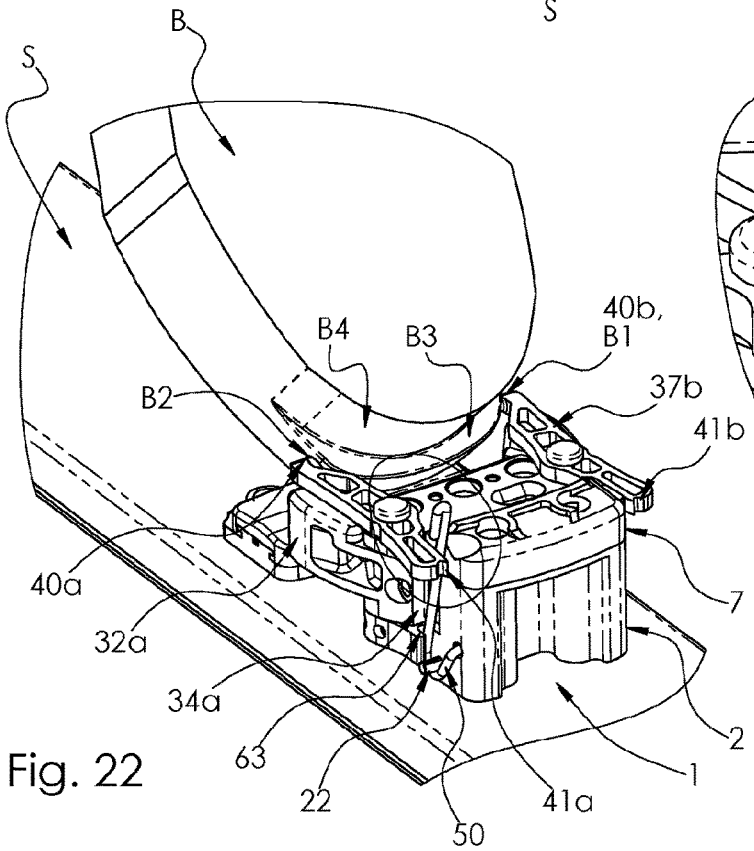
Figure 22A:
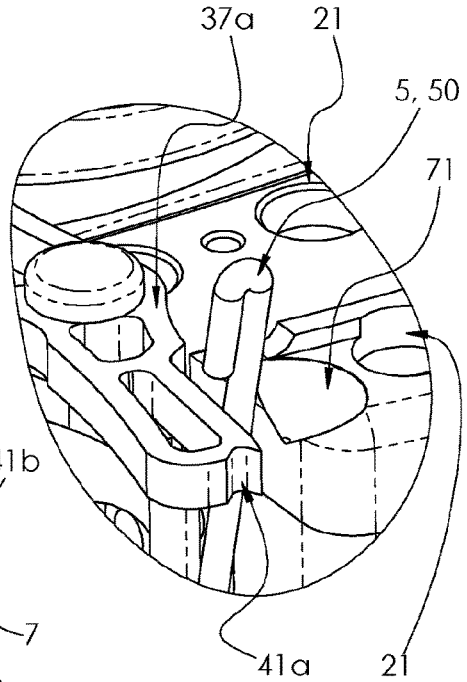

In this further embodiment represented in FIGS. 19 to 22*a* the locking arrangement 5 comprises at least one locking wire spring 50 in lieu of the buckle 51 of previous embodiments. Such locking wire spring 50 is pivotally mounted by a bottom end inserted in a mating hole of the protection casing for the lateral security release device 36. The locking wire spring(s) 50 is further pivotable about an axis formed of a dowel pin 22 (see FIG. 21*a*) projecting laterally from the protection casing. The locking arrangement 5 can be moved about the dowel pin 22 between two active positions corresponding to when the touring pins 40*a*, 40*b* are swung into their engaged positions or not about their pivoting arbors 33*a*, 39*a*; 33*b*, 39*b* for use in slope ascending or ski touring utilisation of the binding, as shown in FIGS. 21 and 22*a*.

The locking wire spring 50 can be pivoted forward and located into front notch 41*a* as shown in FIG. 21*a* to provide sufficient clearance at the touring pin 40*a* to allow a user to position a corresponding features B1, B2 of a front end B3 of ski boot B about the touring pins 40*a*, 40*b* of the second arms 37*a*, 37*b*. Practically, the ski boot B has been positioned by the user onto a first touring pin 40*b*, of the respective second arm 37*b* having been rotated to mate a side magnet 60 prior to engagement of the boot B. Then, prior to closing the binding for the ski touring and walking mode the user has located the locking wire spring in a locking notch 41*a* located at the opposite locking end 38*a* of the second arm 37*a*. This maintains said second arm 37*a* in an open position until a user releases the locking wire spring from the notch 41*a* to close and lock the touring pins 40*a*, 40*b* into the engaged positions.

FIG. 22*a* shows the locking wire spring 50 finding its equilibrium of forces position in between the aforementioned two active positions of the locking arrangement 5. Now the system is locked automatically by a balance of the locking wire spring 50 natural urging force toward the ski boot B between protection casing of the lateral security release device 36 and the second arm 37*a* surface with a ski boot B in place between touring pins 40*a*, 40*b*. Dimensional variances from different boot manufactures from left to right of conical touring pin corresponding holes B1, B2 are automatically adjusted for by the locking arrangement 5 when the locking wire spring 50 moves no further towards the ski boot B as visible within FIGS. 22, 22A.

On the side of the cover 7 next to the locking arrangement 5 said cover comprises a conical guiding surface 71. This conical surface 71 permits and guides for the purposes of releasing spring 50 from notch 41*a* of second arm 37*a* any object the user wishes to use, for example: a tip of a ski pole or a person's fingers or any other object to activate the automatic closing and locking of the touring arm system thus driving and wedging the locking spring 50 between protection casing cover 7 and second arm 37*a* by its own spring forces. This creates an equilibrium of forces when ski boot B is arranged on the touring pin 40*b* as shown in FIGS. 22 to 22*a*. Due to the slow tapering of a surface between second arm 37*a* and spring force of locking wire spring 50 the system becomes locked automatically until a reversing force is applied to locking spring tip to remove locking arrangement 5 from between touring pin arm 37*a* and protection casing of the front ski binding assembly.

The locking wire spring 50 is guided between its multiple active positions and restrained laterally by a second locking notch 63 arranged at the side of the fastening platform 2 next to said locking wire spring 50. In said second locking notch 63 the locking wire spring 50 is restrained fully when the front ski binding assembly 1 is mounted upon a ski board S and said locking wire spring is sufficiently powerful enough to force the arm 37*a* and its touring pin 40*a* in engagement with the ski boot B. Meanwhile the other second arm 37*b* is also sufficiently maintained in engagement with the boot by means of a magnet 60 holding the locking end 38*b* of the second arm 37*b* against a robust lateral or side abutment wall of the cover 7 of the protection casing.

FIG. 20 illustrates how a ski boot B can safely exit the front ski binding assembly 1 through lateral release of one of the first arms 32*a*, 32*b* in downhill skiing mode. In this figure cover 7 is not shown to let internal features of the lateral security release device 36 be visible. The second arms 37*a*, 37*b* are here rotated frontward with their touring pin 40*a*, 40*b* held by magnets 61, which are hidden from view within or under the cover 7 in normal use of the front ski binding assembly 1. As represented in FIG. 20 the lateral release arms of first arm 32*a* are laterally biased and rotated away from the longitudinal axis L when the front end B3 of a ski boot B for whatever reason applies a greater force than the lateral security release device 36 is set to restrain. Thus the FIG. 20 shows a ski boot B that has surpassed this restraining force from said lateral security release device 36 and is in the final stages from being released from the front ski binding assembly 1. As said ski boot B does so it has reached a sufficient angle to engage with the second arm 37*a*, at a point near the locking ends 38*a* which then drives said second arm 37*a* off its corresponding retaining magnet 61, allowing it to rotate together with the first arm 32*a* as it is continued to be pushed by the ski boot B until the latter is freed from the binding as represented in FIG. 20.

Thus the FIG. 20 shows a ski boot B that has surpassed this restraining force from said lateral security release device 36 and is in the final stages from being released from the front ski binding assembly 1. As said ski boot B does so it has reached a sufficient angle to engage with the second arm 37*a*, at a point near the locking ends 38*a* which then drives said second arm 37*a* off its corresponding retaining magnet 61, allowing it to rotate together with the first arm 32*a* as it is continued to be pushed by the ski boot B until the latter is freed from the binding as represented in FIG. 20.

If the overpowering external forces acting upon the ski S or the skiers boot B to front ski binding assembly 1 continues the outward rotation of either first arm 32*a* or 32*b* will continue until the locking ends 38*a*, 38*b* of the second arms 37*a* and, 37*b* make contact with the skiers boot B upon the boot surface B4. Surface B4 is the approximately vertical wall rising above the B3 nose of any ski boot B.

FIG. 20 shows the positions of the first arms 32*a* and the second arms 37*a* in the later stages of a safety release. Contact of the locking end 38*a* of second arms 37*a* with ski boot B surface B4 is shown at approximately point C1 in FIG. 20 when the boot B has reached a sufficient boot angle M to engage both surfaces.

In general the contact of locking ends 38*a*, of the second arm 37*a*, and ski boot surface B4 could be either a pushing or sliding nature or a combination of both with the second arm 37*a*, as shown in principle in FIG. 20.

This contact with second arm 37*a* will disengage the touring pin 40*a* from its disengaged position held by magnet 61 and the second arm 37*a* will rotate freely of an angle and approximately together with the first arm 32*a* as it is continued to be pushed by the boot B surface B4 until the Boot B is completely freed from the front ski binding assembly 1.

The contact and pushing forces needed to disengage the second arms from their respective home positions will not impede the lateral security release device 36 to any significant degree. Even as can be imaginable in all conditions of temperature, snow and dirt build-up of the front ski binding assembly 1. This will be tested by the ski binding manufacturer/s.

Thereby ensuring a safe release function of all ski boots to ski binding combinations in all conditions as stipulated and certified compatible by the ski binding manufacturer/s of this ski binding design. The ski binding manufacturer may define the range of compatible ski boots by ISO norms or otherwise as preferred by the manufacturer and communicate appropriately to users.

Figure 23:
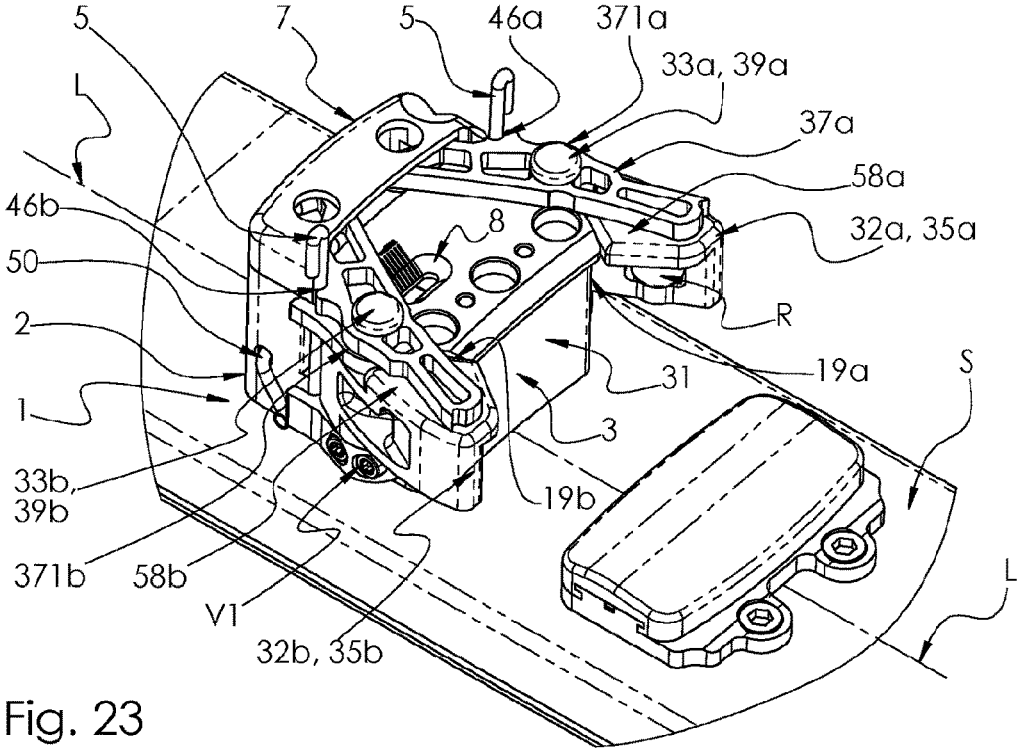
FIGS. 23 to 24 represent a fourth alternative embodiment of a front ski binding assembly according to the invention.
Figure 24:
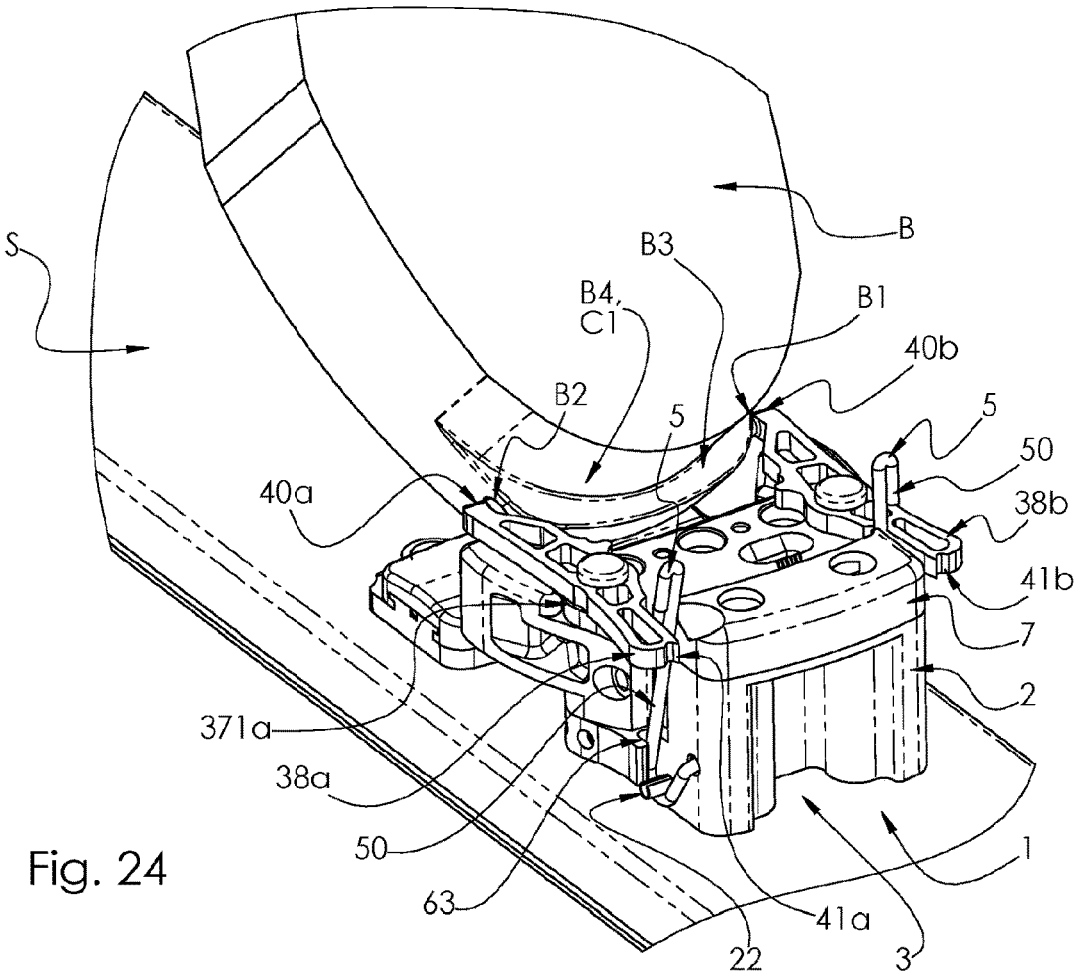
Figure 25:
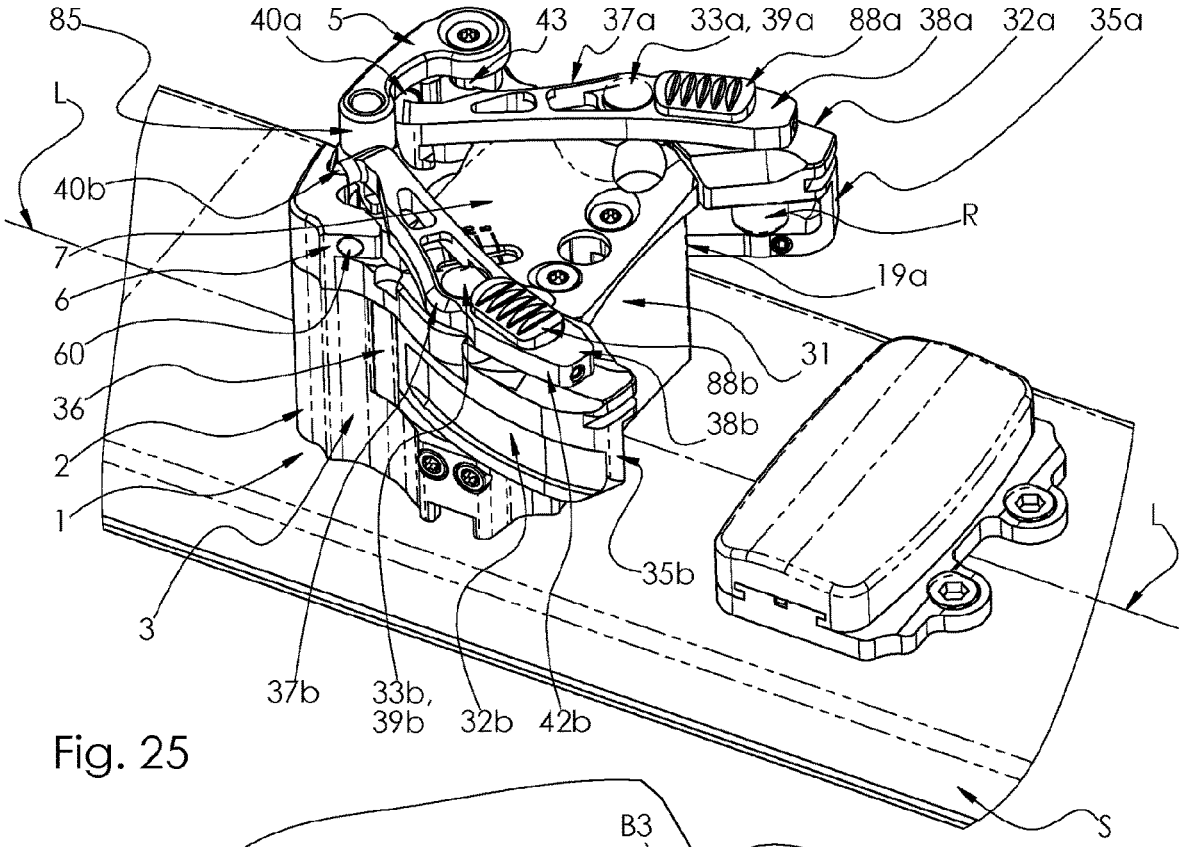
Figure 26:
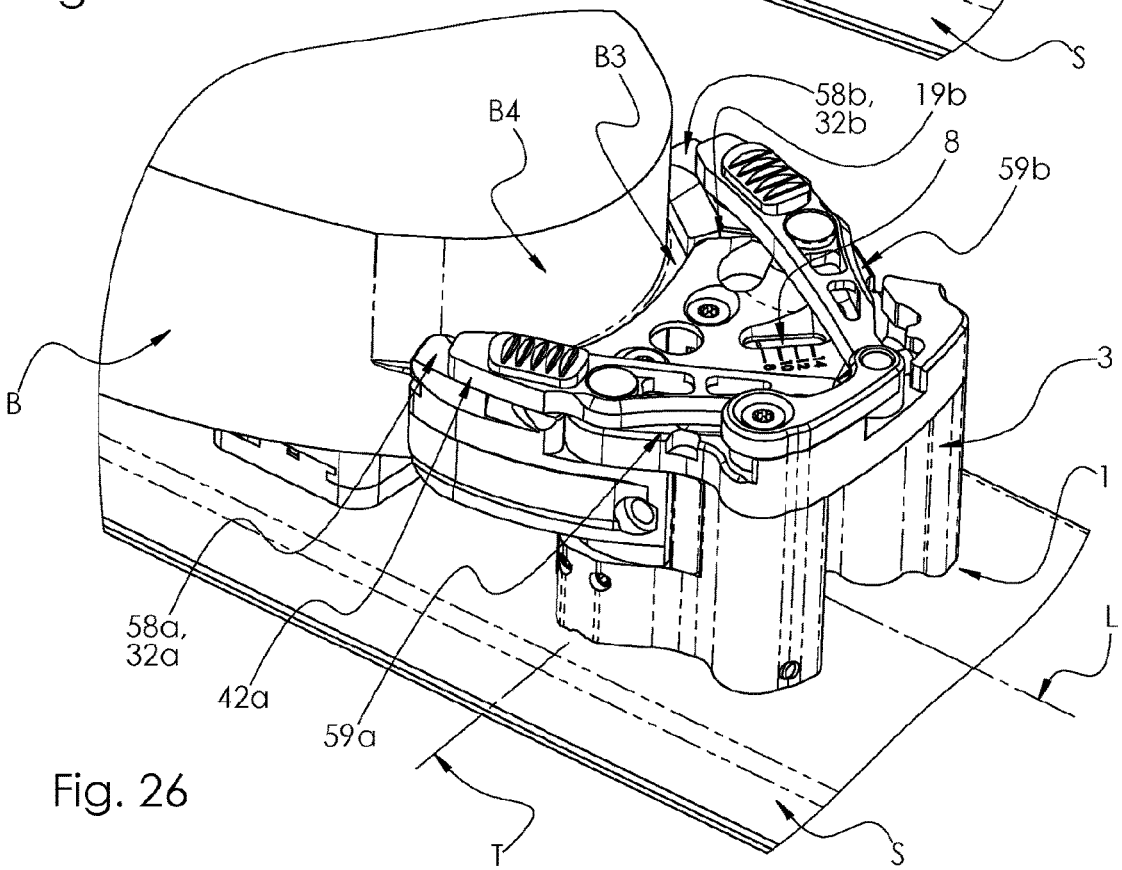
Figure 27:
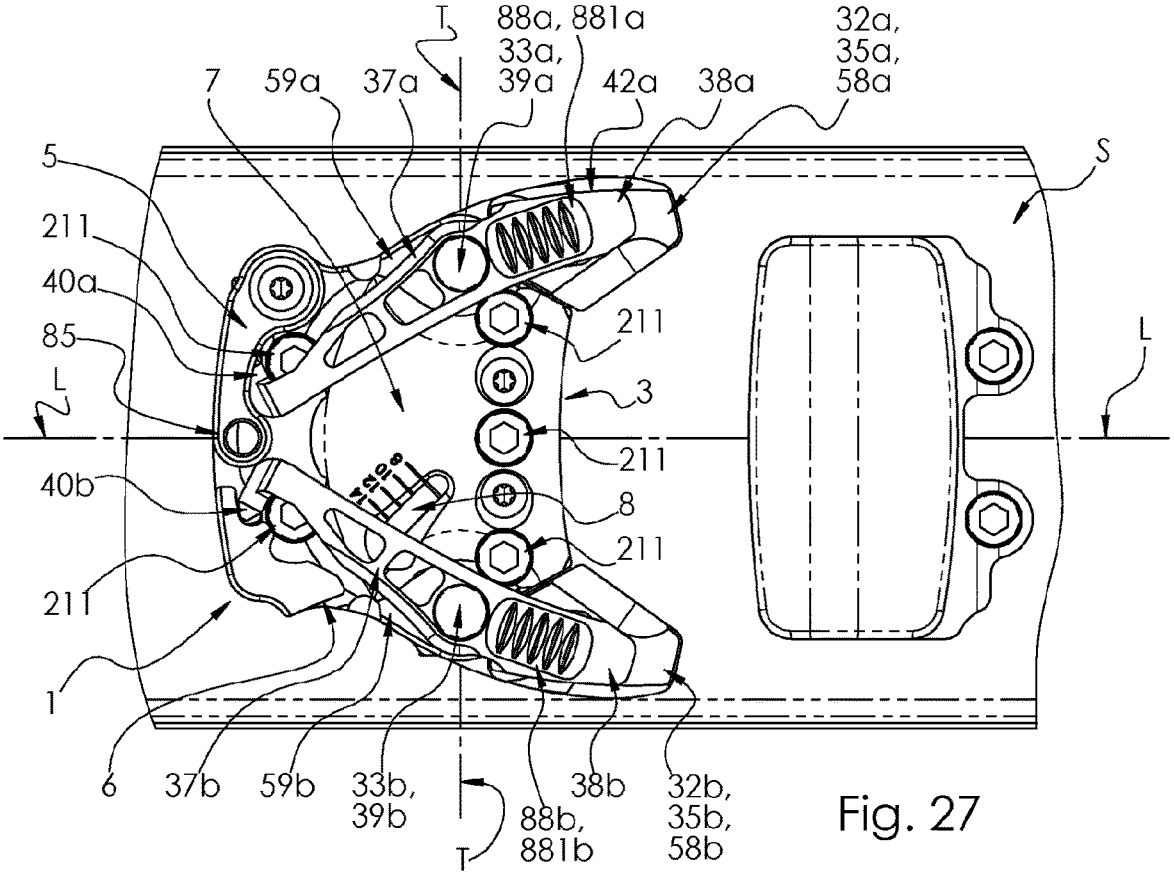
Figure 28:
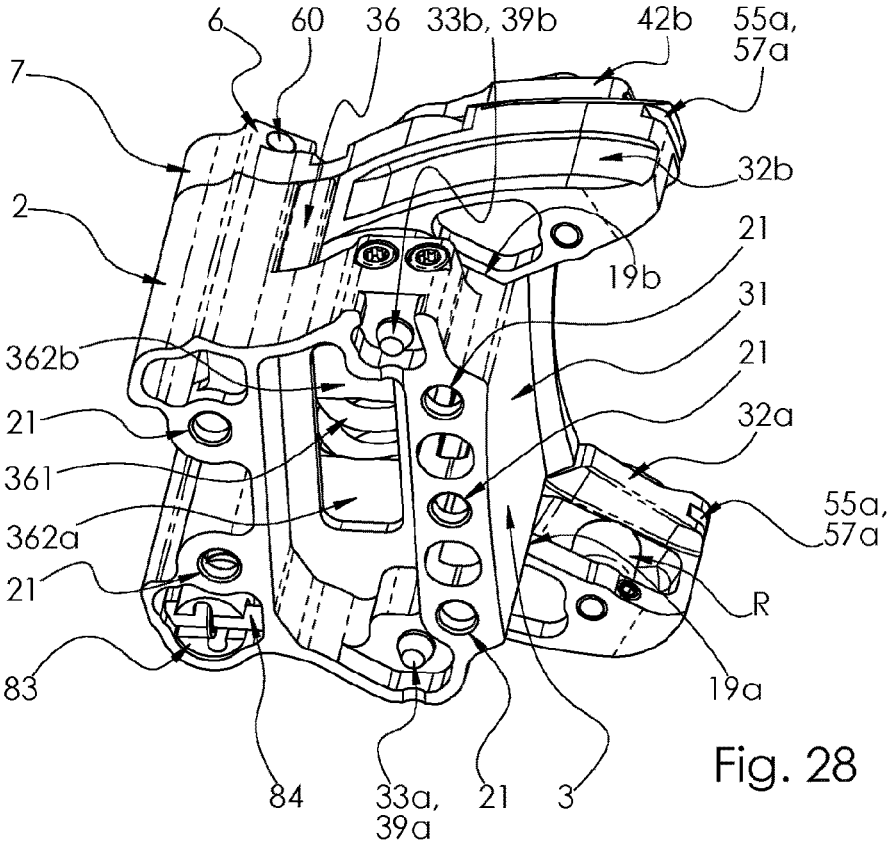

FIGS. 23 to 24 further represent an alternative embodiment with double locking wire spring 50 locking arrangement 5 from the previous embodiment in FIGS. 19 to 22 wherein two locking wire springs 50 replaces magnets for retaining the rotating touring pin arms 37*a*, 37*b*. In this configuration, the front ski binding assembly 1 is symmetrical about the longitudinal axis L and a user needs to actuate both locking springs 50 to shift and lock the second arms 37*a*, 37*b* in ski touring mode. The locking wire springs 50 then play a locking role for the second arms 37*a*, 37*b* in both touring and downhill skiing mode, with additional side notches 46*a*, 46*b* being formed on an inner surface of said arms to serve as a catching and holding feature in the downhill mode, as represented in FIGS. 23 to 24.

In the embodiments represented in FIGS. 15 to 24, the locking ends 38*a*, 38*b* of second arms 37*a*, 37*b* are appropriately shaped to make sliding and pushing contact C1 with surface B4 of the front end B3 of a ski boot B when a release angle has been reached by a ski boot B during a full safety release requiring displacement of said second arms 37*a*, 37*b* in a front ski binding assembly 1. However, contrary to the embodiments of FIGS. 1-14, there is no automatic return of said second arms 37*a*, 37*b*. The user shall manually rotate said second arms 37*a*, 37*b* back into their respective disengaged positions to continue the practice of downhill skiing.

The last embodiment of the front ski binding assembly 1 is represented in FIGS. 25 to 39. This embodiment shows a front ski binding assembly 1 with a further improved locking arrangement 5 for the second arms 37*a*, 37*b*, which are arranged, in their disengaged position, with the touring pins 40*a*, 40*b* pivoted frontward as in previous embodiment and shown in FIGS. 25 to 29*a* in particular of this embodiment.

The locking arrangement 5 located at the end of the second arm 37*a*. It becomes active when the second arm 37*a* is rotated fully in a anticlockwise direction, when viewed from above the second arm 37*a* as per FIGS. 32 to 37, from its disengaged position P1*a* as shown in FIGS. 25 to 31*b* and FIGS. 38 to 39.

The locking arrangement 5, visible in details in FIGS. 34 to 37, is comprised of multiple parts that perform three main functions by a combination of rotational and linear movements about the centre axis of a cam arbor 43.

A first active position for the practice of ski touring of the locking arrangement 5 with handle end 85 is P2*a* as shown in FIGS. 32 to 35 which is manually set by the user before rotation of second arm 37*a*, 37*b*. This position allows the touring pin 40*a* of the second arm 37*a* to be sufficiently spaced apart from the touring pin 40*b* of second arm 37*b* which is set against a fixed abutment wall 6 after rotation to its active position. Once the locking arrangement 5 comprising a handle end 85 is displaced to position P2*a* it is held in this position by a combination of spring forces and geometry of associated and connected parts. This position P2*a* is thus known as the starting position of locking arrangement 5 when the user wishes to enter his ski boot B into said front ski binding assembly 1 for the practice of ascending or ski touring mode.

A second active but variable position of the locking arrangement 5 comprising a handle end 85 for the practice of ski touring is P2*b*, as shown in FIGS. 36 to 37 wherein the locking arrangement 5 is active and actively biasing at least one of the touring pins, in this embodiment said touring pin is touring pin 40*a* of the second arms 37*a* towards the touring pin 40*b* of second arm 37*b* onto corresponding features B1, B2 of a ski boot B, once both second arms are rotated into their respective engaged positions, thus forming an approximate coaxiality of the touring pins 40*a*, 40*b* transversely to the longitudinal axis L of the ski board S, allowing the ski boot B to freely rotate about said axis to permit the practice of ski touring.

A third position of the locking arrangement 5 comprising a handle end 85 is P2*c* wherein the locking arrangement 5 is in its disengaged position for ski touring, as shown in FIGS. 25 to 31 and FIGS. 38 to 39. Advantageously and thanks to remaining rotational forces of the locking arrangement 5 there is a sufficient force of handle end 85 to act upon and to retain both the ski touring pin ends of said second arms 37*a*,37*b* in their ski touring disengaged positions P1*a*, P1*b* with a wedging contact or biasing of said ski touring arms near or at the rear ends of the touring pins 40*a*, 40*b* once said ski touring arms are rotated to their disengaged positions P1*a* and P1*b*, and optionally to said advantage the touring pins 40*a*, 40*b* rest against magnets 61 or a simple abutment wall. Because of the handle end 85 making contact and lightly restraining both the second arms 37*a*, 37*b* in this embodiment the magnets 61 are optional as said above and importantly when the front ski binding assembly 1 is being used for downhill skiing utilisation any lateral release of the ski boot B to said front ski binding assembly 1 will not impede the safe release of the user from said ski binding as will be explained later in detail by two mechanisms within. It should be understood by the reader that in all embodiments described here within the first arms 32*a*, 32*b* for downhill skiing practice constantly remain in an active arrangement for said practice, thus whenever the second arms 37*a*, 37*b* are active for ski touring practice, these arms simply block physical access of a front end B3 of a ski boot B to said downhill skiing first arms 32*a*, 32*b* and conversely when said second arms 37*a*, 37*b* are disengaged as described above the first arms 32*a*, 32*b* become automatically physically accessible to the front end B3 of a ski boot B allowing the binding to be used for downhill skiing practice without any further manipulations or the front ski binding assembly 1.

Cam arbor 43 has a spiral cam 44 at one end of its cylindrical body so that when the second arm 37*a* is rotated fully to make contact with spiral cam 44 of cam arbor 43 and cam surface 42*a* of second arm 37*a* and a rotational movement of cam arbor 43 about its cylindrical body axis is actuated via handle end 85 to provide an increasing or decreasing biasing effect of cam surface 42*a*.

The working of the locking arrangement 5 is further represented in FIGS. 34 to 37. The increasing and decreasing biasing effect of cam surface 42*a* translates in an opposing biasing direction and effect of the touring pin 40*a* as the second arm 37*a* pivots about the arbor 39*a*. This biasing motion of touring pin 40*a* of the second arm 37*a* has enough opening and closing motion to first allow a ski boot B with corresponding mating members B1 and B2 to pass between the pointed tips of touring pins 40*a*, 40*b* and be located firstly onto the stationary second arm 37*b*. Once the touring pin 40*b* of the second arm 37*b* is mated with corresponding mating member B2 of the ski boot B the second arm 37*a* can be biased via a rotation of cam arbor 43 within the locking arrangement 5 (in this embodiment, an anticlockwise motion is realised) until touring pin 40*a* reaches the full depth of corresponding mating member B1 of the skiers boot B.

In typical use the locking arrangement 5 is set to a start position shown as P2*a*, this is achieved by the user manually rotating the handle end 85 (in this embodiment, a clockwise motion is applied) until locating pin 86 which during downhill skiing mode position P2*c* is held in tangential contact with cover surface F1 per FIGS. 35 to 36.

A positive force keeping locating pin 86 in contact with cover surface F1 of cover 7 is created by compression spring 82. Compression spring 82 has one end located inside roll pin 87 which passes transversally across the rotational axis of the cylindrical body of cam arbor 41.

The opposing end of compression spring 82 is both guided and retained coaxially and rotationally to the rotational axis of the cylindrical body of cam arbor 43 by spring plug 83. Spring plug 83 has a recessed and semi-circle slot about the same axis that compression spring 82 is aligned with and features an abutment face D2 is created at one end of the semi-circle slot as shown in FIG. 34*a*. Other coaxial and rotational restraining configurations are easily imaginable in lieu of above description and presented drawings.

Compression spring 82 helical wire end (opposite to end located inside roll pin 87) sits within the described semi-circle slot of spring plug 83 and is forced into contact with abutment D2 by a combination of vertical compression and pre-set (simultaneous) twisting or rotational compression of spring plug 83 as shown in FIG. 34.

Spring plug 83 is retained in the fastening platform 2 of the front ski binding assembly 1 by spring plug shaft 84 as shown in FIG. 34. During assembly of the locking arrangement 5, spring plug 83 is rotated through a minimum number of degrees before spring plug axis 84 is inserted into place through a lower slot of spring plug 83 to both compress vertically along the main axis of the spring 82 a force and to compress or preload a torsional load or force into the spring 82.

The combination of both the compression and torsional forces store in the spring 82 provides the locking arrangement 5 sufficient mechanical energy to function as described here within in the preferred manor.

User manually rotates the lever of handle end 85 to start position P2*a* by rotating clockwise until the cam arbor 43 with locating pin 86 moves off cover surface F1 and into indent D1, FIGS. 36 to 36.

Once locating pin 86 has been pushed into indent D1 from the compression force provided by spring 82 the user can release his manual force from handle end 85. The locking arrangement 5 is now set to P2*a* and ready for auto locking of locking arrangement 5, presented in FIG. 34 to 35.

The user can then rotate both second arms 37*a* and 37*b* into the engaged position for touring.

The second arm 37*b* is held rigidly against a stop surface 6 of the cover 7 by magnet 60 attracting surface 42*b* of second arm 37*b*. It is then possible for the user to align his corresponding mating positions B1 and B2 of ski boot B towards the touring pins 40*a* and 40*b*. Preferably he should mate one touring pin with a corresponding mating position, either B2 with 40*b* or B1 with 40*a*. Once these are mated he should visually align the opposing corresponding mating positions with the remaining touring pin.

Finally, the user is ready to activate the auto locking of the locking arrangement 5. This is done simply by pressing on handle surface F2 of the locking arrangement 5. This will force the locating pin 86 downwards and out of indent D1 and back in tangential contact with cover surface F1. The stored torsional force within compression spring 82 will continue to rotate cam arbor 43 towards the position of P2*b* causing an outwards biasing action upon cam surface 42*a* which in turn biases the touring pin 40*a* via arbor 39*a* into and onto the corresponding mating surfaces of B1 in the front end B3 of a user's ski boot B.

The user's ski boot B is now locked and ready for ski touring practise when the spring 82 can no longer rotate the cam arbor 43 any further as all possible biasing motion from the second arms 37*a* and 37*b* has been removed from the system. Any width or linear relationship difference from one ski boot B to another of the corresponding mating features B1 and B2 is automatically adjusted for by the locking arrangement 5.

To remove the user's ski boot B from the locking arrangement 5 the user may simply reapply a manual force to the handle end 85 in the direction of P2*a* or clockwise here within this embodiment. Before the handle end 85 reaches the position P2*a* the user's ski boot B may already be released sufficiently for the corresponding mating positions B1 and B2 to be freed from touring pins 40*a* and 40*b*.

Returning the front ski binding assembly 1 to downhill skiing mode simply requires rotation of the second arms 37*a*, 37*b* touring ends, pin 40*a*, 40*b* to their corresponding homing magnets 61 at respective positions P1*a* and P1*b*. During this action the handle end 85 will be pushed from position P2*b* to P2*c*. The handle end 85 under the stored torsional energy of spring 82 will maintain contact with the touring pins 40*a* and 40*b* whilst the touring pins 40*a* and 40*b* are in contact with their respective magnets 61.

The user can now practise downhill skiing by placing his ski boot B into the downhill skiing arms 32*a* and 32*b* unimpeded by the touring second arms 37*a*, 37*b*.

FIG. 37 shows locking arrangement 5 finding its equilibrium of forces position, known as locked or position P2*b*. The system is locked automatically by a balance of the spring 82 torsional driving force of spiral cam 44 of cam arbor 43 radially outwards from its rotational axis and biasing touring pins 40*a* of second arm 37*a* with a ski boot Bin place. Position P2*b* will vary depending on a number of factors:

- Dimensional variances from different boot manufactures from left to right conical holes are automatically adjusted for by the system when it self-locks;
- Foreign objects in the left to right conical holes of the ski boot B (For example, snow, ice, dirt, etc—Locking arrangement 5 will continue to adjust and close onto the ski boot B automatically as snow, ice, and dirt is pushed out of the conical holes during use);
- Wear of the ski boot B and second arms and locking arrangement 5 parts with age of the front ski binding assembly 1.

Figure 31A:
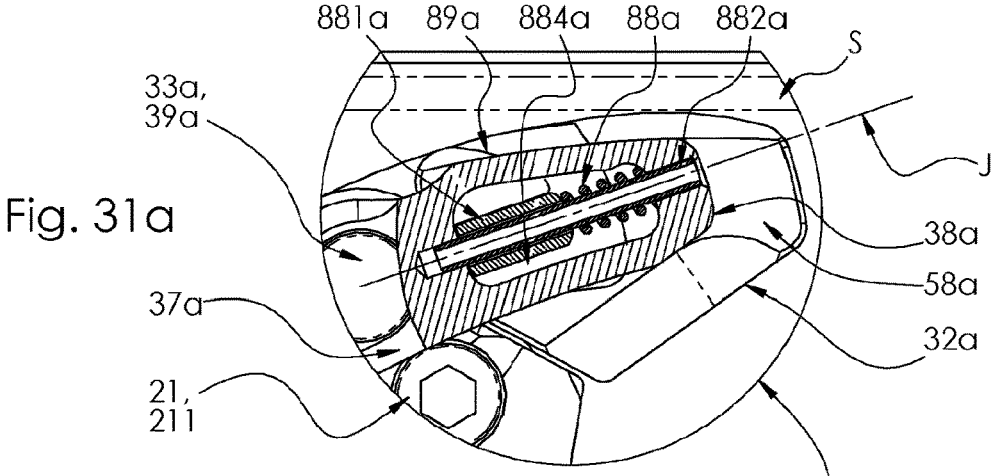
Figure 31:
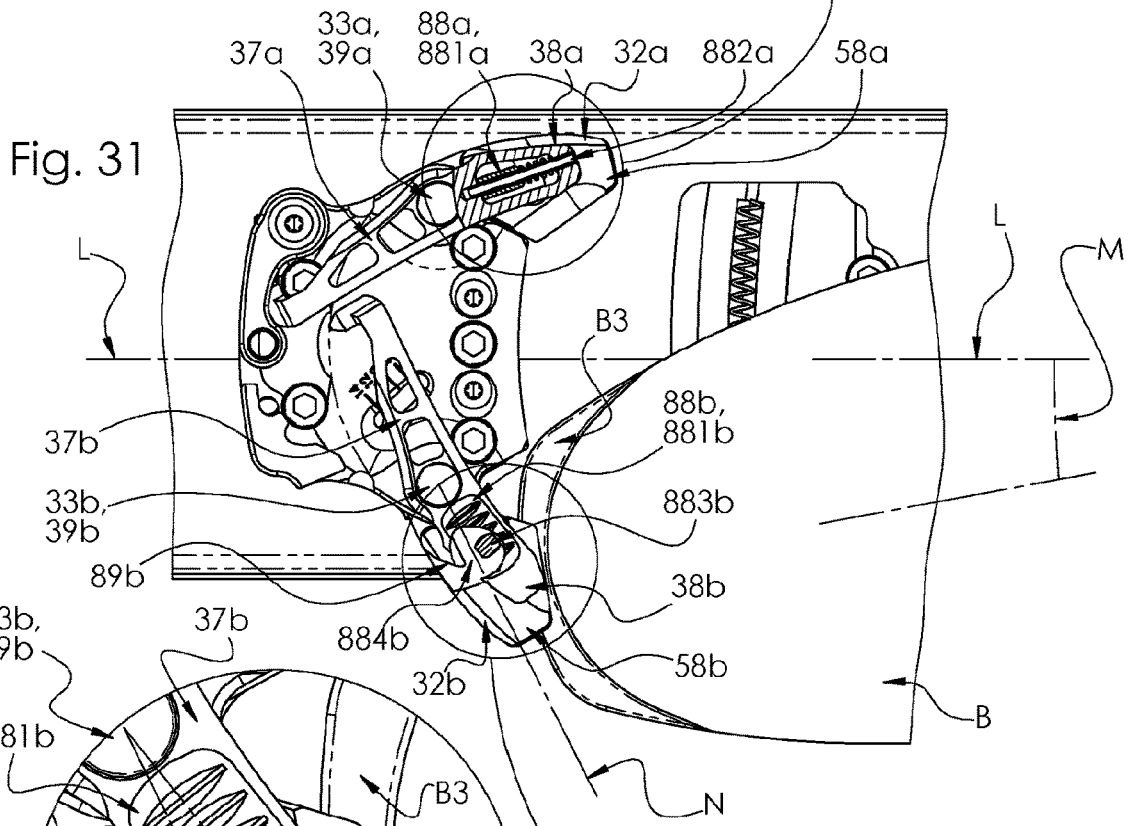
Figure 31B:
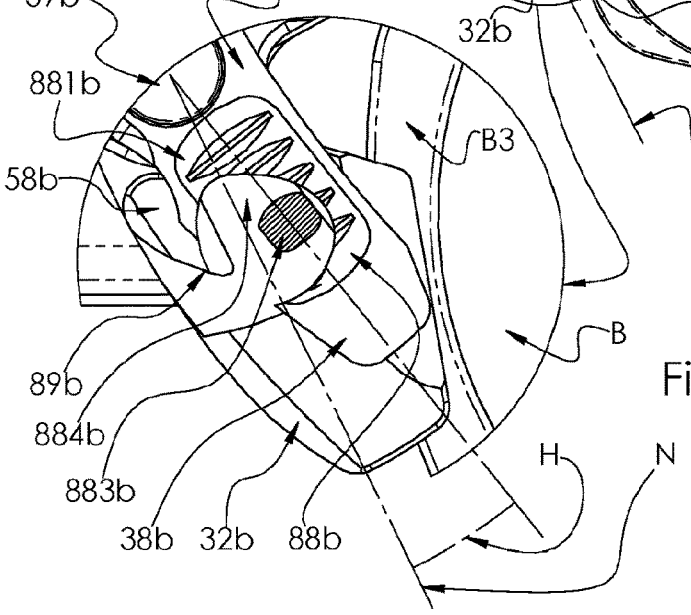

FIGS. 30 to 31*b* illustrate how a boot B can safely exit the front ski binding assembly 1 through lateral release of at least one of the independent first arms 32*a*, 32*b* in downhill skiing mode.

As understood in all previous embodiments, for the user to be released from the front ski binding assembly 1 firstly a lateral force from a ski boot B greater than the pre-set safety release force of the lateral security device 36 must be realised. A first arm 32*a*, 32*b* then rotates about its arbor 33*a*, 33*b* thus releasing the ski boot B and reducing injury risks to the user. During the rotation of said first arms 32*a*, 32*b* said arms will reach a certain point or release angle N from its original home angle J whereby the locking ends 38*a*, 38*b* of second arms 37*a*, 37*b* may require to be free or helped in rotation together with the first arms during said lateral release of the first arms 32*a*, 32*b* to prevent any restraint of the first arms 32*a*, 32*b* to the complete safe release of said ski boot B from the front ski binding assembly 1.

FIGS. 31 to 33 describe an example of a latch system 88*a*, 88*b* of linear displacement. It provides a more precise control of the motion of the second arms 37*a*, 37*b* in relation to the first arms 32*a*, 32*b* via said latch system 88*a*, 88*b*. The latter comprises a minimum of one latching component from the second arms 37*a*, 37*b* to connect with a minimum of one corresponding component within the first arms 32*a*, 32*b*, thus allowing a precise amount of angular rotation of the first arms 32*a*, 32*b* to occur before engagement and rotation of said second arms 37*a*, 37*b* and their respective locking ends 38*a*, 38*b*. Thus the engagement and displacement of the second arms 37*a*, 37*b* occurs at the same release angle N for every type of ski boot B used within said front ski binding assembly 1.

In some safety release events where a full safety release from the front ski binding assembly 1 is not achieved, for example when the external loads that initiated the safety release fall below the lateral security release device 36 pre-set safety force before the users ski boot B was fully released from said front ski binding assembly 1. In such events the first arms 32*a*, 32*b* are then capable to both re-centre the ski boot B within the front ski binding assembly 1 and advantageously reset the second arms 37*a*, 37*b* to their home angle J so that the skier can continue skiing without either or both of the second arms 37*a*, 37*b* being out of their disengaged positions P1*a*, P1*b* for downhill skiing.

A further advantage of this latch system 88*a*, 88*b* is the resetting of said second arms 37*a*, 37*b*, which crucially ensures there is no possibility of any entanglement between the second arms 37*a* and second arms 37*b*, which could occur when any said second arm 37*a*,37*b* is left out of its home angle J and perpendicular to the other said second arm 37*a*,37*b* and there is a sudden reversal of external release forces requiring a lateral release of the opposing first and second arms 32*a*, 37*a*, 32*b*, 37*b* thereby potentially causing an entanglement that could then prevent a clean full safety release of the front ski binding assembly 1.

Transitioning the second arms 37*a*, 37*b* from their disengaged positions P1*a*, P1*b* with said latch system 88*a*, 88*b* requires the user to manually and momentarily hold open the latch system 88*a*, 88*b* whilst unlatching is effectuated. After a small rotation of the second arms 37*a*, 37*b* sufficiently beyond their latching features the latching system can then be released. The second arms 37*a*, 37*b* are now free to be fully rotated to their engaged positions previously detailed unimpeded by any further manual actions to the latching system 88*a*, 88*b*. Returning the second arms 37*a*, 37*b* to their disengaged positions P1*a*, P1*b* is as simple as in the embodiments of FIGS. 15 to 24, wherein the user can simply manually rotate said second arms 37*a*, 37*b* until they are fully returned to positions P1*a*, P1*b* as the latch system 88*a*, 88*b* will open and close itself thanks to cam surfaces within said latching system.

FIGS. 31 to 32 best show the internal details for said latch system 88*a*, 88*b*, with partial view through the latch mechanism to better comprehend the inside arrangements of the latch system 88*b* through the locking end 38*b* of second arm 37*b*. A latch cam surface 89*a* and 89*b* of the first arms 32*a*, 32*b* leads up to a notch 884*a*, 884*b* (FIGS. 31 to 32) within the top surface 58*a*, 58*b* of first arms 32*a*, 32*b* that is aligned with the home angle J of the second arms 37*a*, 37*b* in relation to the first arms 32*a*, 32*b*. In doing so a tooth shape is formed at the intersection of said cam surface 89*a*, 89*b* and said notch within the first arms 32*a*, 32*b*, this tooth forms the latching hook or latch catch for which a linearly slide-able latch button 881*a*, 881*b* guided preferably within locking ends 38*a*, 38*b* of second arms 37*a*, 37*b* engages with when the latch system 88*a*, 88*b* is latched together.

In this embodiment the latch button 881*a*, 881*b* is both guided and spring loaded along a pin 882*a*, 882*b* aligned with home angle J mounted preferably in the locking ends 38*a*, 38*b* of second arms 37*a*, 37*b* as best shown in FIGS. 31 to 31*a*. Said latch button 881*a*, 881*b* in such a guided configuration has sufficient contact surface to the upper surface of the second arms 37*a*, 37*b* such that it cannot rotate about its guided pin. Thus said latch button 881*a*, 881*b* has only a freedom of movement linearly along said guide pin 882*a*, 882*b* to the length limits of said pin. The latch button 881*a*, 881*b* comprises advantageously a cam follower 883*a*, 883*b* in the form of a stud or pin extending perpendicularly towards the first arm 32*a*, 32*b* underneath. This cam follower is arranged to follow the previously mentioned cam and tooth shaped features 89*a*, 89*b* of first arms 32*a*, 32*b* so that when the second arms 37*a*, 37*b* and first arms 32*a*, 32*b* align along the home angle J there is a positive catching of said features thus, preventing any unwanted unlatching of said second arms 37*a*, 37*b* without a manual intervention by the user.

Advantageously within the upper surfaces of first arms 32*a*, 32*b* there is sufficient place to enlarge one side of previously said home angle J aligned notch so that there can be a degree of mechanical play or mechanical freedom H of the first arms 32*a*, 32*b* in relation to the longitudinal axis L before to engage the second arms 37*a*, 37*b* via said latch system 88*a*, 88*b*. This advantage is detailed above in the description. The range of mechanical freedom H between first and second arms 32*a*, 32*b*, 37*a*, 37*b*, of an already displaced first arm 32*b* is best shown in FIG. 31*b* where the maximum tooth misalignment or mechanical freedom H (created by the enlargement of previously said notch) from release angle N, which is the equivalent of home angle J if the first arm 32*b* was not laterally biased by boot angle M of ski boot B.

The invention claimed is:

1. A front ski binding assembly (1) for a ski board (S), the assembly comprising:

a fastening platform (2) comprising fastening means (21) to fixedly mount said assembly on a ski board (S) upper surface, said platform (2) defining a longitudinal direction (L) and a transverse direction (T) perpendicular to the longitudinal direction;

a front boot-retaining mechanism (3) mounted onto said platform (2) for retaining a user's boot (B) in either a slope ascending or in a slope descending configuration, said boot-retaining mechanism (3) comprising:

a front boot abutment wall (31) extending on said platform orthogonally to said longitudinal direction (L) thereof, and two first arms (32*a*, 32*b*) pivotally mounted each on a first arbor (33*a*, 33*b*) with respect to the platform (2) and the front boot abutment wall (31) at longitudinal ends of the front boot abutment wall (31), a lateral security release device (36) arranged in cooperation with first ends (34*a*, 34*b*) of the first arms (32*a*, 32*b*) to apply thereon a biasing force urging second ends (35*a*, 35*b*) of said first arms (32*a*, 32*b*) towards the longitudinal direction (L) of the platform (2) and to allow each of said first arms (32*a*, 32*b*) to rotate away from said longitudinal direction (L) about a respective first arbor (33*a*, 33*b*) upon application by a user's boot of a force higher than said biasing force on interior surfaces of said respective first arms (32*a*, 32*b*), and two second arms (37*a*, 37*b*) pivotally mounted about second arbors (39*a*, 39*b*), said two second arms comprising touring pins (40*a*, 40*b*) at respective ends of said second arms to engage corresponding mating members (B1, B2) on front end sides of a user's boot in a slope ascending configuration, said second arms (37*a*, 37*b*) being movable between an engaged-position where the touring pins (40*a*, 40*b*) are engaged with such said mating members (B1, B2) on a user's boot (B) and a disengaged position where the touring pins (40*a*, 40*b*) are disengaged from said mating members (B1, B2);

said second arms (37*a*, 37*b*) being pivotally arranged on top of said first arms (32*a*, 32*b*) and lockable in said engaged and disengaged positions by a locking arrangement (5).

2. The front ski binding assembly (1) according to claim 1, wherein each of the two first arms (32*a*, 32*b*) are independently movable in rotation about its first arbors (33*a*, 33*b*).

3. The front ski binding assembly (1) according to claim 1, wherein each of the two second arms (37*a*, 37*b*) are independently movable in rotation about its second arbor (39*a*, 39*b*).

4. The front ski binding assembly (1) according to claim 1, wherein the first (33*a*, 33*b*) and second arbors (39*a*, 39*b*) are a same single arbor for both the first two arms (32*a*, 32*b*) and the second two arms (37*a*, 37*b*).

5. The front ski binding assembly (1) according to claim 1, wherein the locking arrangement (5) comprises a buckle (51) pivotally arranged at an end of one of the second arms (37*a*, 37*b*) or on the platform (2) to engage with the other of the second arms (37*a*, 37*b*) in both the slope ascending or in the slope descending configuration.

6. The front ski binding assembly (1) according to claim 1, wherein the locking arrangement (5) comprises a locking spring pivotally arranged on said front boot-retaining mechanism (3) to one of said second arms (37*a*, 37*b*) in the slope ascending or in the slope descending configuration.

7. The front ski binding assembly (1) according to claim 6, wherein the front boot-retaining mechanism (3) and the second arms (37*a*, 37*b*) comprise locking notches (41*a*, 41*b*) for the locking spring in at least one of the slope ascending or in the slope descending configuration.

8. The front ski binding assembly (1) according to claim 1, wherein the locking arrangement (5) comprises magnets to hold at least one of the second arms (37*a*, 37*b*) in at least one of the slope ascending or in the slope descending configuration.

9. The front ski binding assembly according to claim 1, wherein the second arbors (39*a*, 39*b*) are respectively arranged between said touring pins (40*a*, 40*b*) and respective opposing locking ends of said second arms, said respective locking ends each comprising a biasing and locking means (45*a*, 45*b*, 53, 5) to lock the respective second arm in either the engaged or the disengaged position.

10. The front ski binding assembly according to claim 1, wherein the front abutment wall (31) is immobile and fixed on the platform (2) in all positions of the first (32*a*, 32*b*) and second arms (37*a*, 37*b*).

11. The front ski binding assembly according to claim 1, wherein the first arms (32*a*, 32*b*) and lateral security release device (36) are operational in both the engaged and disengaged positions of the second arms (37*a*, 37*b*).

12. The front ski binding assembly (1) according to claim 1, wherein the lateral security release device (36) comprises a compression spring (361) exerting said biasing force against the first arms (32*a*, 32*b*).

13. The front ski binding assembly (1) according to claim 1, wherein the biasing force is adjustable.

14. The front ski binding assembly (1) according to claim 12, wherein the lateral security release device (36) comprises a set of interchangeable cams (362) being adjustable about an end of said compression spring (361), said cams (362) each defining a tubular chamber arranged for receiving said compression spring end and having a different depth to provide a varying biasing force on said compression spring (361).

15. The front ski binding assembly according to claim 14, wherein the interchangeable cams (362) each comprises a biasing force value and indicator marked on a surface and arranged to match with a graduated scale provided at a visualization window (8) in a cover (7) of the lateral security release device (36).

16. The front ski binding assembly (1) according to claim 1, wherein the locking arrangement (5) comprises a spiral cam (44) mounted to a pivot axis (43) connected to a handle end (85), a compression spring (82) being coaxially mounted about the pivot axis (43) and the spiral cam (44) being arranged to contact a locking end of one of the second arms (37*a*, 37*b*) upon rotation of the handle end (85) towards a locking position (P2*c*), wherein a positive biasing of one or both of said second arms (37*a*, 37*b*) is provided by the spiral cam on at least one of the second arms (37*a*, 37*b*).

17. The front ski binding assembly (1) according to claim 16, wherein guiding pins (86, 87) are provided at a distance from each other along a length of the pivot axis (43) to exert a increasing compressive force onto the compression spring (82) upon rotation of the handle end (85) and linked pivot axis (43) by a user to lock the second arms in said engaged position.

18. The front ski binding assembly (1) according to claim 1, wherein the second arms (37*a*, 37*b*) comprise a latch mechanism (88*a*, 88*b*; 89*a*, 89*b*) configured to connect each second arm to a respective first arm (32*a*, 32*b*) thereunder in the disengaged positions of said second arms at least to prevent impairing a lateral safety release of a user's boot in slope descending configuration.

19. The front ski binding assembly (1) according to claim 1, wherein guidance in rotation is achieved by means of retaining slots (55*a*, 55*b*) at an end (35*a*, 35*b*) of said first arms (32*a*, 32*b*) and mating tab ridges (56*a*, 56*b*) arranged underneath the touring pins (40*a*, 40*b*) of the second arms (37*a*, 37*b*), further preventing said second arms (37*a*, 37*b*) from being pulled excessively away from upper surfaces of the first arms (32*a*, 32*b*).

20. The front ski binding assembly (1) according to claim 1, wherein biasing means (371*a*, 371*b*) are arranged between the first and second arms to return the second arms to their disengaged position to prevent entanglement of said second arms (37*a*, 37*b*) with each other during a safety release of the first arms (32*a*, 32*b*).

* * * * *